US009698535B2

(12) United States Patent
Cornelius et al.

(10) Patent No.: US 9,698,535 B2
(45) Date of Patent: Jul. 4, 2017

(54) CONNECTOR SYSTEM IMPEDANCE MATCHING

(71) Applicant: APPLE INC., Cupertino, CA (US)

(72) Inventors: William Cornelius, Saratoga, CA (US); Mahmoud R. Amini, Sunnyvale, CA (US); Zheng Gao, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/706,997

(22) Filed: May 8, 2015

(65) Prior Publication Data

US 2015/0349465 A1 Dec. 3, 2015

Related U.S. Application Data

(60) Provisional application No. 61/990,700, filed on May 8, 2014, provisional application No. 62/004,834, filed on May 29, 2014.

(51) Int. Cl.
*H01R 13/6471* (2011.01)
*H01R 13/6469* (2011.01)
(Continued)

(52) U.S. Cl.
CPC ..... *H01R 13/6469* (2013.01); *H01R 13/6473* (2013.01); *H01R 13/665* (2013.01); *H01R 12/721* (2013.01)

(58) Field of Classification Search
CPC ..... H01R 13/6469; H01R 13/6467; H01R 13/6471; H01R 13/6473; H01R 13/6466; H01R 13/6477; H01R 13/6474
(Continued)

(56) References Cited

U.S. PATENT DOCUMENTS 5,386,344 A * 1/1995 Beaman ..... H01R 12/79 174/261
6,129,555 A * 10/2000 Daikuhara ..... H01R 23/688 439/60
(Continued)

FOREIGN PATENT DOCUMENTS

JP 2005-531121 A 10/2005

OTHER PUBLICATIONS

International Search Report for International PCT Application No. PCT/US2015/029994, dated Aug. 18, 2015, 3 pages.

*Primary Examiner* — Abdullah Riyami
*Assistant Examiner* — Harshad Patel
(74) *Attorney, Agent, or Firm* — Kilpatrick Townsend & Stockton, LLP

(57) ABSTRACT

Connector inserts and receptacles that provide signal paths having desired impedance characteristics. One example may provide a connector system having a connector insert and a connector receptacle. Contacts in the connector insert may form signal paths with corresponding contacts in the connector receptacle. Additional traces in the connector insert and receptacle may be part of these signal paths. The signal paths may have a target or a desired impedance along their lengths such that the power paths electrically appear as transmission lines. Constraints on physical dimensions of the connector insert and connector receptacle contacts may result in variations in impedance along the signal paths. Accordingly, embodiments of the present invention may provide structures to reduce these variations, to compensate for these variations, or a combination thereof.

21 Claims, 21 Drawing Sheets

(51) Int. Cl.
*H01R 13/66* (2006.01)
*H01R 13/6473* (2011.01)
*H01R 12/72* (2011.01)

(58) Field of Classification Search
USPC .. 439/620.2, 636, 637, 638, 620.22, 620.24, 439/620.06, 620.25, 620.13
See application file for complete search history.

(56) References Cited

U.S. PATENT DOCUMENTS 6,425,766 B1 * 7/2002 Panella ..... H05K 1/117 439/59
6,932,649 B1 * 8/2005 Rothermel ..... H01R 13/6658 439/620.01
7,244,126 B2 * 7/2007 Morana ..... H01R 13/6658 439/76.1
7,520,757 B2 * 4/2009 Bartholomew ..... H05K 1/0293 439/76.1
7,625,215 B2 * 12/2009 Sawada ..... H05K 1/142 439/61
7,997,937 B2 * 8/2011 Kondo ..... H01R 24/62 439/607.4
8,727,809 B2 * 5/2014 Mongold ..... H01R 12/721 439/607.14
2003/0180011 A1 * 9/2003 Aronson ..... H01R 23/688 385/92
2004/0229510 A1 * 11/2004 Lloyd ..... H01R 9/032 439/607.01
2005/0059296 A1 3/2005 Wang
2005/0118876 A1 6/2005 Niitsu et al.
2005/0260872 A1 11/2005 Bassler et al.
2008/0028941 A1 * 2/2008 Kunga ..... A47J 31/005 99/275
2009/0221165 A1 * 9/2009 Buck ..... H01R 13/514 439/108
2010/0203768 A1 8/2010 Kondo et al.

* cited by examiner

CONNECTOR SYSTEM IMPEDANCE MATCHING

CROSS REFERENCE TO RELATED APPLICATIONS

The present application claims the benefit of U.S. provisional application No. 61/990,700, filed May 8, 2014, and 62/004,834, filed May 29, 2014, which are incorporated by reference.

BACKGROUND

The amount of data transferred between electronic devices has grown tremendously the last several years. Large amounts of audio, streaming video, text, and other types of information content are now regularly transferred among desktop and portable computers, media devices, handheld media devices, displays, storage devices, and other types of electronic devices.

Data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to form pathways for data and power.

These connector inserts may include contacts or pins that form signal paths with contacts or pins in the corresponding connector receptacles. It may be desirable that these signal paths have a matched impedance over their lengths in order to increase the data rate that the signal path can support. That is, it may be desirable that these signal paths appear as transmission lines having a specific impedance. These transmission lines may convey signals that are substantially free of reflections, rise and fall time distortions, and other artifacts that may slow data transfers. Such transmission lines may be capable of handling higher data transmission rates than a signal path that does not have a matched impedance. This may be particularly important for large data transfers.

New generations of electronic devices are consistently becoming thinner and smaller. This reduction in device thickness has led to connector systems having a reduced height. This results in individual connector system components becoming thinner as well. Unfortunately, as these components become thinner, it may become harder to maintain the desired impedance along these signal paths.

Thus, what is needed are connector inserts and receptacles that provide signal paths having desired impedance characteristics.

SUMMARY

Accordingly, embodiments of the present invention may provide connector inserts and receptacles that provide signal paths having desired impedance characteristics. An illustrative embodiment of the present invention may provide a connector system having a connector insert and a connector receptacle. Contacts in the connector insert may form electrical paths with corresponding contacts in the connector receptacle. These electrical paths may be used as signal paths, power paths, or other types of electrical paths, but may be referred to here as signal paths for simplicity. Additional traces in the connector insert and receptacle may be part of these signal and power paths.

The signal paths may have a target or desired impedance along their lengths such that the signal paths electrically appear as transmission lines. Constraints on physical dimensions of the connector insert and connector receptacle contacts may result in variations in impedance along the signal paths. Accordingly, embodiments of the present invention may provide structures to reduce these variations in impedance. Other embodiments of the present invention may provide structures to compensate for these variations, or structures may be provided to reduce and compensate for these variations in impedance. It should be noted that the impedances described here are impedances at a frequency, for example, the signal frequency or a frequency component of signals conveyed by these signal paths.

In one illustrative embodiment of the present invention, a connector insert may include spring finger contacts. These contacts may engage corresponding surface contacts on a connector receptacle tongue when the connector insert is inserted into the connector receptacle. Traces in or on the tongue may be used to route signals to and from the connector receptacle contacts. Signal paths in this connector system may include the spring finger contacts in the connector insert and the contacts and traces in and on the tongue of the connector receptacle.

These signal path impedances may have various errors or fluctuations along their lengths. For example, a contact in the connector insert may be located above or below a ground plane, where the ground plane is located along a center line of the connector insert. The contact may have a capacitance to the ground plane, where the capacitance increases with the proximity of the contact to the ground plane. Since impedance is inversely proportional to the square root of the capacitance, when the contact is closer to the ground plane, the impedance may decrease. Keeping the spacing between the contact and ground plane relatively constant may allow the impedance to be well controlled along the contact's length, but there may be a discontinuity where the insert contacts extend beyond the ground plane and housing. The nearest ground or fixed potential may be further away at this point, leading to an increase in impedance in the signal path at that point. Conversely, the size of receptacle contacts needed to provide a wiping function and to reliable engage the insert contacts may lead to an increase in capacitance and a resulting decrease in impedance at that point. Also, excess portions of the connector insert and receptacle contacts may create stubs, which may act as capacitors, thereby further reducing the impedance at the connector receptacle contact.

Illustrative embodiments of the present invention may reduce or at least partially compensate for these and other impedance errors. In one example, the ground plane in the connector insert may extend such that it engages or contacts a corresponding ground plane in a connector receptacle. In this way, the connector insert contacts do not extend beyond this combined ground plane and the discontinuity that would otherwise result may be avoided.

In these and other embodiments of the present invention, the decrease in impedance near the connector receptacle surface contacts may be reduced. For example, signal contacts having a reduced depth may be provided. These reduced depth contacts may have an increased distance to a center ground plane in the tongue. The increased distance may reduce coupling capacitance, thereby increasing local impedance. In this and other embodiments, power contacts may be deeper or thicker to provide an increase in current handling capability.

In other illustrative embodiments of the present invention, the ground plane may be thinned below the signal contacts to further increase a distance between a signal contact and the ground plane. In still other illustrative embodiments of the present invention, the ground plane may have openings below the signal contacts. While this may allow cross-talk between signal contacts on a top and bottom of the connector receptacle tongue, the impedance error may be reduced enough to provide an overall improvement in performance. In these and other embodiments, the traces may be offset from each other to reduce this crosstalk.

In this and other embodiments of the present invention, a ground plane may reside near a center of the tongue. In other embodiments of the present invention, the central plane may be a power plane. Other planes may be located above or below these central planes. Again, these may be power or ground planes. For example, a power plane may be centrally located and ground planes may be positioned above and below the central plane. A high capacitance dielectric may be placed between the power and ground planes in order to form bypass capacitors between power and ground. This capacitance may help to reduce the return path impedance and may help to reduce power supply noise. For example, a dielectric having a dielectric constant or relative permittivity on the order of 100 to 1,000 or higher may be used.

In the above embodiments of the present invention, impedance errors may be reduced. In these and other embodiments of the present invention, the above impedance errors may be compensated for. For example, traces connected to contacts on the connector receptacle tongue may be arranged to provide higher or lower impedances than the desired impedance of the signal paths in order to compensate for the above, and other, impedance errors. In an illustrative embodiment of the present invention, a distance between these traces and a ground plane may be varied, for example from tens of microns to hundreds of microns, in order to adjust the impedance of a portion of a trace in a tongue. This impedance may be set such that the average or effective impedance for the overall signal trace meets a desired specification or target.

In still other embodiments of the present invention, the arrangement of these traces may be varied to construct a distributed element filter. For example, the width of traces in a signal pair, a distance or spacing between traces in a signal pair, as well as distances between these traces and a ground plane may be varied in a receptacle tongue. Also, a material that the tongue or other connector portions are made of may be varied or removed in order to change a dielectric constant or permittivity between or among traces, contacts, ground planes, and other structures. These variations may result in different common-mode impedances for the signal path pair along various sections of the traces. In various embodiments of the present invention, differential-mode impedances may remain at least approximately constant among multiple of these sections. These sections having different common-mode impedances may be arranged to form a common-mode filter to filter or reduce common-mode energy in signals conveyed along the signal path. That is, the signal path pair may be used to convey a differential signal, and the variance of the common-mode impedance may be used to form an in-line filter to remove common-mode energy from the differential signal pair. For example, a choke, notch, low-pass, high-pass, band-pass, or other type filter may be formed. These and similar techniques may be used to filter power supplies as well, for example by forming a common-mode low-pass or choke filter.

Again, in illustrative embodiments of the present invention, parameters and dimensions of traces and other structures on a tongue may be varied to change impedances. These impedances may include a single-ended impedance, which may be the impedance of a contact or trace to ground. These impedances may also include a common-mode impedance, which may be the impedance between a pair of contacts and traces to ground, and a differential-mode impedance, which may be the impedance between a pair of contacts or traces to each other.

These impedances may be varied in several ways in embodiments of the present invention. For example, traces may be made wider, narrower, thicker, thinner, closer to each other, and farther apart. They may be thinned or thickened. The dielectric between them may be varied. Holes may be formed in the dielectric or conductive material and structures.

These different techniques may be employed by various embodiments of the present invention to accomplish various goals. For example, in small connectors, the small geometries may result in large capacitances between a signal trace or contact and ground. This may result in a low impedance to ground at the signal frequencies. These various techniques may be used by embodiments of the present invention to increase signal path impedance to ground. Also, common-mode and differential-mode impedances may be varied among different sections of traces or interconnect in a connector. These impedances may be arranged to form distributed element filters along these traces.

Again, these different techniques may be used to increase or otherwise adjust an impedance of a signal path. In an illustrative embodiment of the present invention, a pair of traces may be formed on a plastic tongue. Material may be removed from sections of the area between the traces on the tongue. This may act to decrease the dielectric constant or permittivity between the traces in these sections, thereby increasing the impedance. In another illustrative embodiment of the present invention, this material may be removed from an area between contacts or traces and a center ground plate of the connector. Again, this may act to decrease the dielectric constant or permittivity between the traces in these sections, thereby increasing the impedance. This material may be removed in relatively large sections. In other embodiments of the present invention, micro-perforations or other sized perforations, in either or both the material between the traces and a ground plane or in the ground plane itself, may be used to increase impedance. In these and other embodiments of the present invention, these perforations may be formed on the contacts themselves. These perforations may form a photonic bandgap, which may also be used as a filter element. In other embodiments of the present invention, one or more sections of a center ground plane may have a raised or lowered section below one or more contacts to lower or raise an impedance at the contact.

Again, common-mode and differential-mode impedances may be varied among different sections of traces or interconnect in a connector. These impedances may be arranged to form distributed element filters along these traces. Other structures, such as open ended or shorted stubs may be included in these filters. In an illustrative embodiment of the present invention, traces may be arranged such that a common-mode impedance may be varied among different sections of a pair of the traces. This may be used to form a common-mode filter that may block common-mode currents and reduce electro-magnetic interference. The traces may also be arranged such that a differential-mode impedance may be held relatively constant among the sections. Accordingly, this filter may provide limited differential filtering and may have only a limited effect on a differential signal conveyed on the traces. In this way, common-mode impedances may be varied along a trace, while a differential-mode impedance may remain relatively constant along the trace. These sections may be arranged using distributed element filter and transmission filter techniques to form filters to block common-mode signals while allowing differential-mode signals pass.

While embodiments of the present invention may be used with connector systems having spring finger contacts in the insert and surface contacts on a tongue in the receptacle, other embodiments of the present invention may provide connector systems where the receptacle includes spring finger contacts and the insert includes a tongue supporting a number of contacts. In still other embodiments, a tongue may be in either, both, or neither the insert and receptacle, and various types of contacts may be employed in the insert and receptacle.

The connector receptacle tongues employed by embodiments of the present invention may be formed in various ways of various materials. For example, the tongue may be formed using a printed circuit board. The printed circuit board may include various layers having traces or planes on them, where the various traces and planes are connected using vias between layers. The printed circuit board may be formed as part of a larger printed circuit board that may form a logic or motherboard in an electronic device. In other embodiments of the present invention, these tongues may be formed of conductive or metallic traces and planes in or on a nonconductive body. The nonconductive body may be formed of plastic or other materials.

In various embodiments of the present invention, contacts, ground planes, traces, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connectors that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connectors may provide pathways for signals that are compliant with various standards such as Universal Serial Bus (USB) including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connectors that may be used to provide a reduced set of functions for one or more of these standards. In various embodiments of the present invention, these interconnect paths provided by these connectors may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
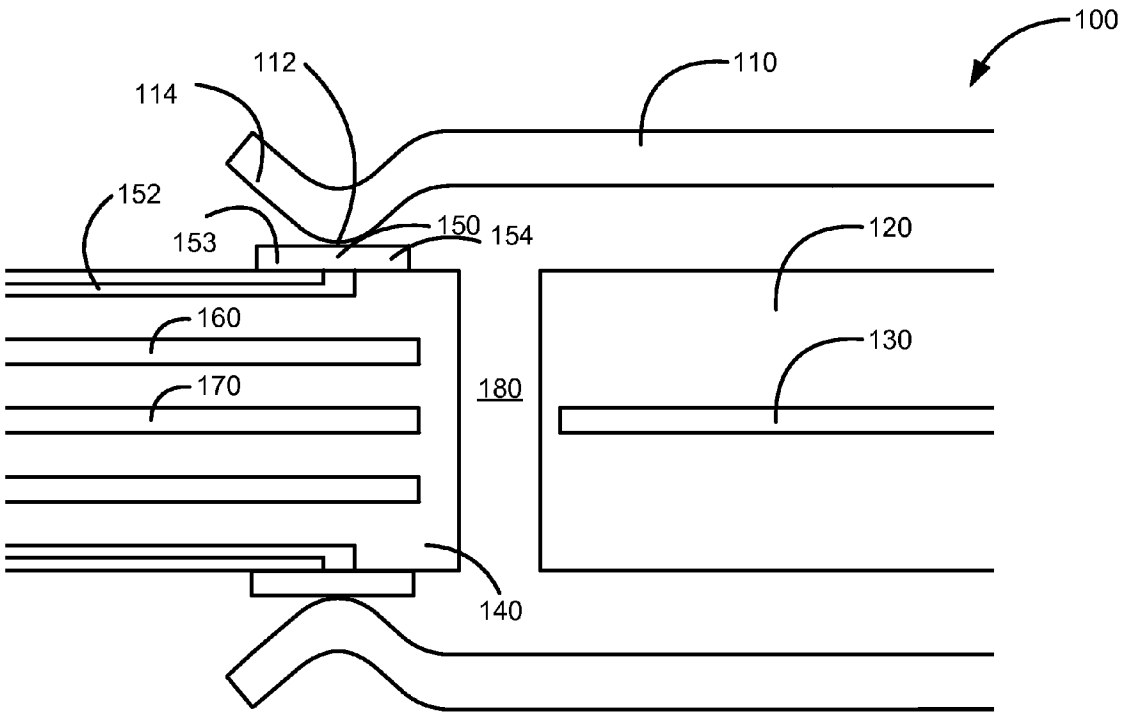
FIG. 1 illustrates a connector system according to an embodiment of the present invention.

FIG. 1 illustrates a connector system according to an embodiment of the present invention. This figure, as with the other included figures, is shown for illustrative purposes and does not limit either the possible embodiments of the present invention or the claims.

In connector system 100, a portion of a connector insert has been inserted into a connector receptacle. Shown are connector insert contacts 110 supported by connector insert housing 120. Connector insert contacts 110 may electrically connect to conductors in a cable (not shown.) A central ground plane 130 may be located in connector insert housing 120 and may be connected to the cable as well. The connector insert may be inserted into a connector receptacle including tongue 140. Tongue 140 may support a number of contacts 150. Traces 152 may electrically connect contacts 150 to circuitry inside a device housing tongue 140. Tongue 140 may further include one or more planes 160 and 170. Planes 160 and 170 may be power supply, ground, or other types of planes. For example, plane 170 may be a power supply plane having ground plane on a top and bottom side.

In this example, signals may propagate along contacts 110 until they reach contact point 112. The signals may then propagate through contacts 150 and traces 152. Conversely, signals may propagate in the other direction, through traces 152 to contacts 150, through contact point 112 and through connector insert contact 110.

Again, it may be desirable that this signal path have a matched impedance along its entire length. For example, it may be desirable that this signal path have a 50 ohm, 85 ohm, 110 ohm, or other specific impedance along its entire length. Unfortunately, aspects of these paths may create impedance errors, variations, or fluctuations along their lengths. These errors may cause reflections and signal distortions that may reduce the data rates that would otherwise be achievable.

Accordingly, embodiments of the present invention may mitigate or reduce these errors. In this way, signals may be distorted to a lesser degree such that sufficiently high data rates are still achievable. For example, impedance errors may be limited resulting in signal rising and falling edges that may be distorted to a limited degree such that high data rates are possible. These and other embodiments may compensate for, or at least somewhat cancel, these errors. In this way, signals may be distorted in ways that cancel each other out such that significantly high data rates are still achievable. For example, signal rising and falling edges may be distorted in ways the cancel each other out such that high data rates remain possible. Some of the sources of these impedance errors, as well as both reduction and cancellation strategies for them are shown in the following figures.

Figure 2:
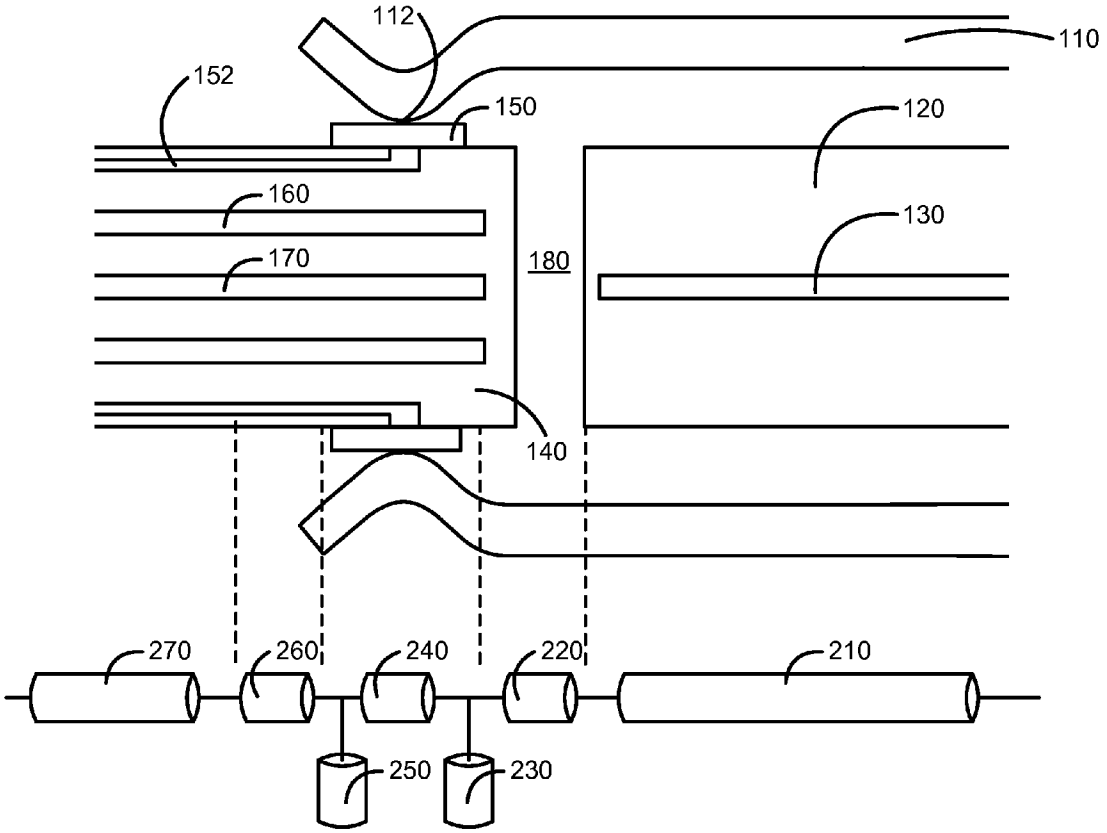
FIG. 2 illustrates a transmission line model for a signal path in the connector system of FIG. 1.

FIG. 2 illustrates a transmission line model for a signal path in the connector system of FIG. 1. In this example, a length of connector insert contact 110 over central ground plane 130 in the connector insert may be modeled as transmission line 210. A spacing between connector insert contact 110 and ground plane 130 may be sufficiently large and well-controlled that transmission line 210 may have a characteristic impedance very near a desired level.

As connector insert contact 110 extends beyond housing 120, it may reach an open area 180 between housing 120 and a connector insert tongue 140 in the connector receptacle. Transmission line 220 may be used to model this length. The characteristic impedance of transmission line 220 may be higher than desired since ground plane 130 may be absent below connector insert contact 110. In this and the other examples, an impedance may be increased by increasing an inductance, decreasing a capacitance, or both. Similarly, an impedance may be decreased by decreased an inductance, increasing a capacitance, or both.

At point 112, connector insert contact 110 may engage corresponding contact 150 on tongue 140 of the connector receptacle. The portion of the signal path may be modeled by transmission line 240. Extraneous edges and portions of connector insert contact 110 and connector receptacle contact 150 may be modeled as transmission line stub portions 230 and 250. Specifically, portion 114 of contact 110 and portions 153 and 154 of contact 150, and others, may be modeled as transmission line stub portions 230 and 250. These transmission lines stubs may act as capacitors to reduce the characteristic impedance along this length.

After reaching contact 150, signals may be routed through traces 152. Traces 152 may have various sections, modeled here as transmission lines 260 and 270.

Figure 3:
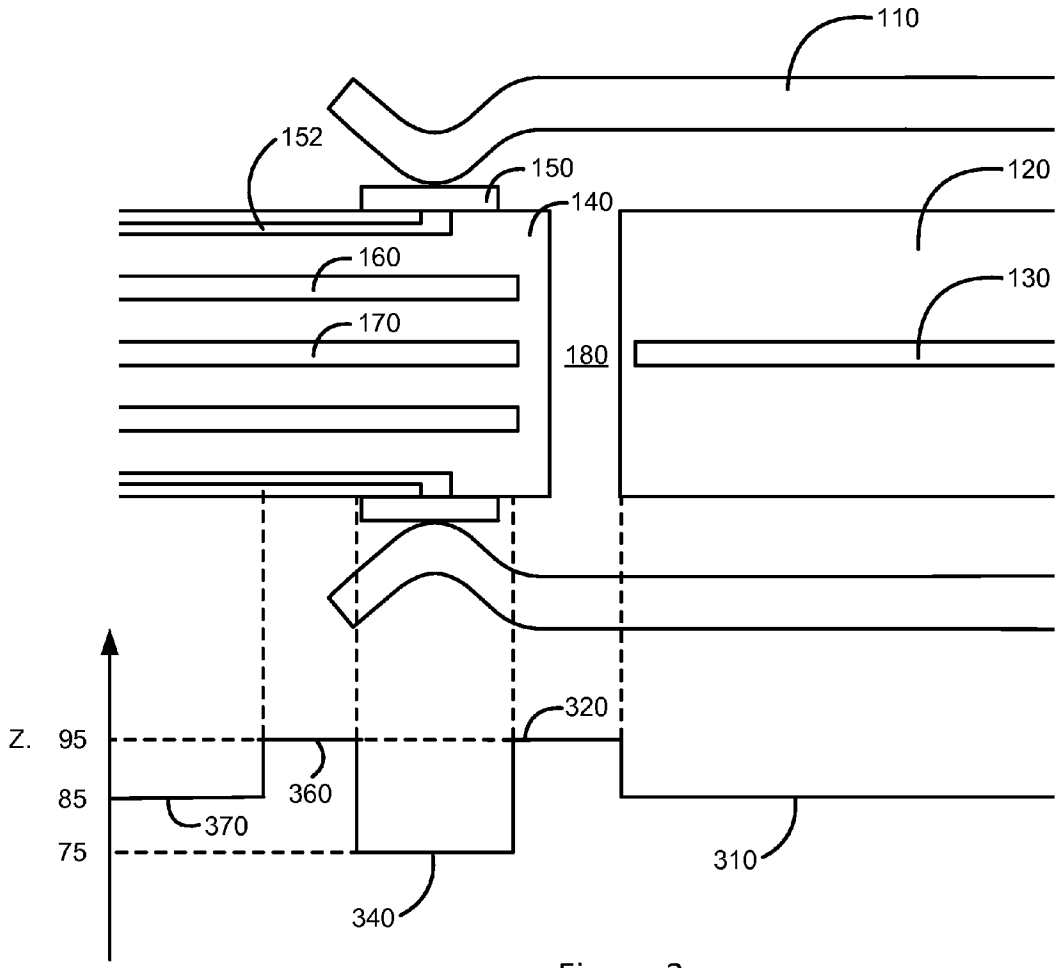
FIG. 3 illustrates an example of the variation in impedance along a signal path for the connector system of FIG. 1.

FIG. 3 illustrates an example of the variation in impedance along a signal path for the connector system of FIG. 1. Again, where connector insert contact 110 is above ground plane 130 and housing 120 of the connector insert, the characteristic impedance 310 may be very near a desired impedance level, shown here as 85 ohms. Where ground plane 130 is absent below contact 110, the impedance 320 may rise, in this example to 95 ohms. Further along, stub portions of the contacts may reduce impedance. In this example, the resulting impedance 340 may be shown as 75 ohms.

The relative lengths and impedance of transmission lines 220 and 240 may determine whether the overall impedance of the signal is higher or lower than desired. In this example, the lengths and impedances are shown as causing the signal path impedance to be low. To compensate for this, the impedance 360 may be purposefully raised, for example to 95 ohms. Similarly, its length may be adjusted to provide a correct amount of increase in impedance. A remaining portion of traces 152 may be at or near the nominal impedance of 85 ohms. In this way, the total average or effective impedance of the signal path may be adjusted to the desired level.

In this example, the impedance 310 may correspond to the characteristic impedance of transmission line 210, impedance 320 may correspond to the characteristic impedance of transmission 220, the impedance 340 may correspond to the characteristic impedance of transmission line 240 and stubs 230 and 250, the impedance 360 may correspond to the characteristic impedance of transmission line 260, while impedance 370 may correspond to characters impedance of transmission line 270 in FIG. 2.

In this and other embodiments of the present invention, one or more connector insert contacts 110 may be ground or power contacts. Contacts 150 on tongue 140 may directly connect to one of the planes 160 or 170, for example through a via or other interconnect structure. This direct connection may reduce the effect of transmission line components 250, 260, and 270. This may improve the impedance of the ground or power contacts. It may also reduce loop currents that may otherwise cause connector suckout. The width and length of the via may be varied to adjust an inductance of the direct connection. This inductance may be tuned to compensate for one or more of the capacitances associated with transmission lines 210, 220, 230, 240, or other capacitance. That is, a peaking or gain provided by the inductor may be used to cancel or reduce a dip or attenuation caused by one or more of the capacitances associated with transmission lines 210, 220, 230, 240, 250, 260, 270, or other capacitance.

Similar techniques may be used on contacts 110 that are not power or ground contacts. That is, inductances, for example formed using vias, may be inserted in the signal path on tongue 140. These inductances may be tuned to provide a peak that cancels or reduces a dip or attenuation caused by one or more of the capacitances associated with transmission lines 210, 220, 230, 240, or other capacitance.

In one example, spacing 180 may be increased in order to make transmission line 220 more inductive and have a higher impedance to compensate for the capacitances caused by transmission line stubs 230 and 250. An increase in spacing 180 may cause an increase in crosstalk between contacts 110 on opposite sides of the connector insert, so there may be a limit on how big this spacing 180 may be made.

Again, embodiments of the present invention may reduce these various errors in order to limit signal distortions through these paths. These and other embodiments of the present invention may compensate or attempt to reduce or cancel a total error through the signal path. Examples of structures used to reduce impedance errors are shown in the following figures.

Figure 4:
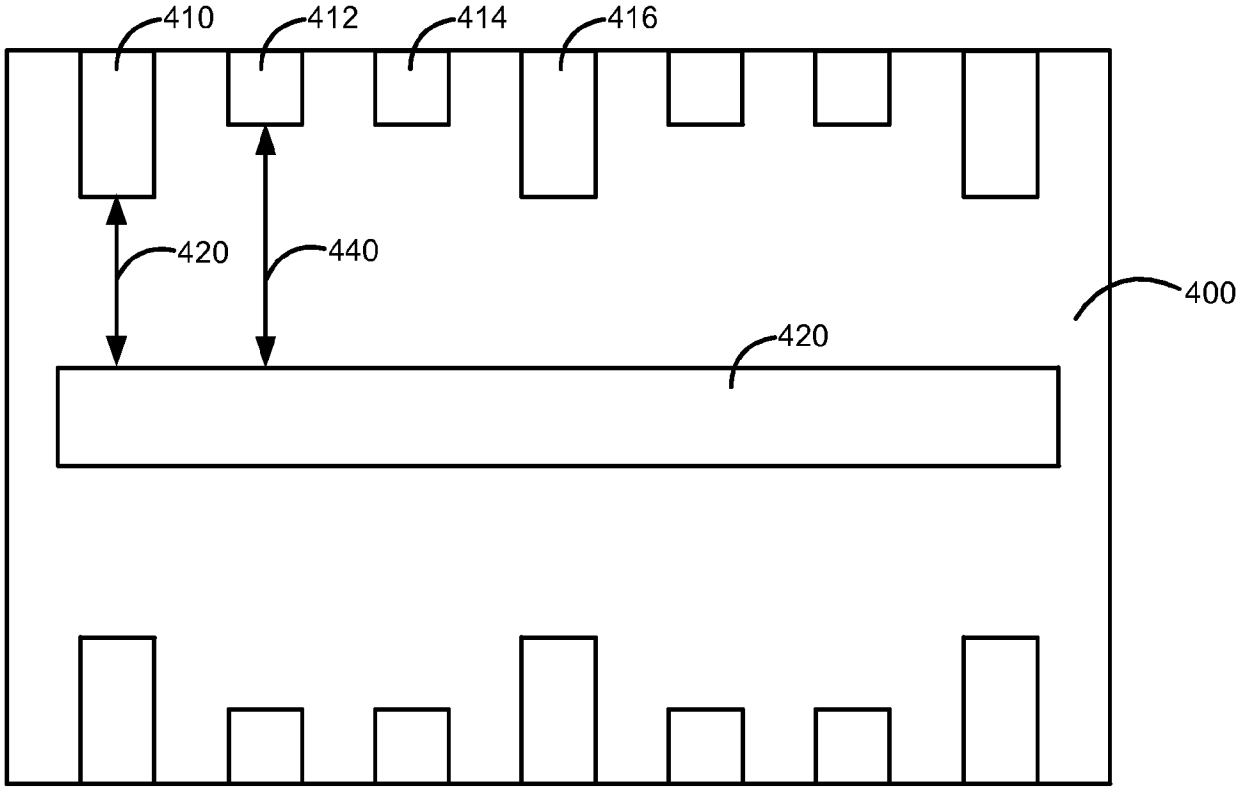
FIG. 4 illustrates a front cross-section view of a connector receptacle tongue according to an embodiment of the present invention.

FIG. 4 illustrates a front cross-section view of a connector receptacle tongue according to an embodiment of the present invention. In this example, contacts or traces 410 and 416 on tongue 400 may be used for power, ground, or other low impedance path. Contacts or traces 412 and 414 may be used to convey signals, such as a differential signal. A depth of contacts or traces 412 and 414 may be reduced such that a distance 440 to ground plane 420 may be greater than a distance 420 below power or ground contact 410. This increase in distance may raise the impedance of a signal line at contacts or traces 412 and 414. In FIG. 2, this may be used to increase a characteristic impedance of transmission line 240, while in FIG. 3 this may be used to raise impedance 340. Using this arrangement, these contact impedances may be increased, while power and ground contacts or traces 410 may retain a large cross-section to increase their current carrying capabilities.

Again, in various embodiments of the present invention, tongue 400 may be formed in various ways. For example, tongue 400 may be formed of metallic contacts, traces, and planes in a plastic or other nonconductive housing. In embodiments where the tongue is a printed circuit board, meaningful differences in contact depths may be difficult to achieve and more reliance may be placed on the other reduction and compensation techniques shown below, though the reduction techniques shown in FIGS. 4-9 may be suitable for printed circuit board tongues as well. In the various embodiments of the present invention where the tongue may be formed of a printed circuit board, the printed circuit board may be part of a larger logic or motherboard for an electronic device.

Figure 5:
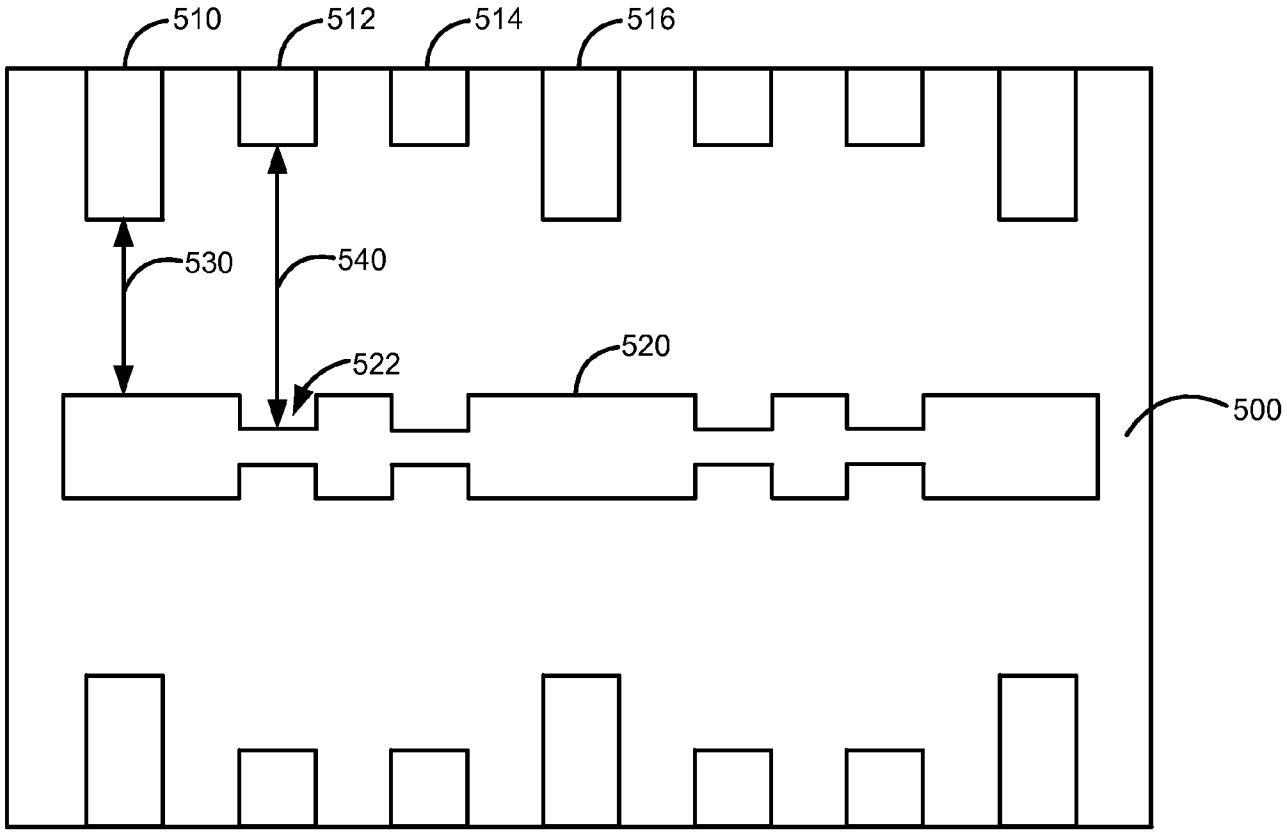
FIG. 5 illustrates another front cross-section view of a connector receptacle tongue according to an embodiment of the present invention.

FIG. 5 illustrates another front cross-section view of a connector receptacle tongue according to an embodiment of the present invention. In tongue 500, ground plane 520 may be notched at points 522 to further increase distance 540 relative to distance 530. As before, contacts or traces 510 and 516 may be used to convey power and ground or other low impedance paths, while contacts or traces 512 and 514 may be used to convey signals, such as a differential signal.

Figure 6:
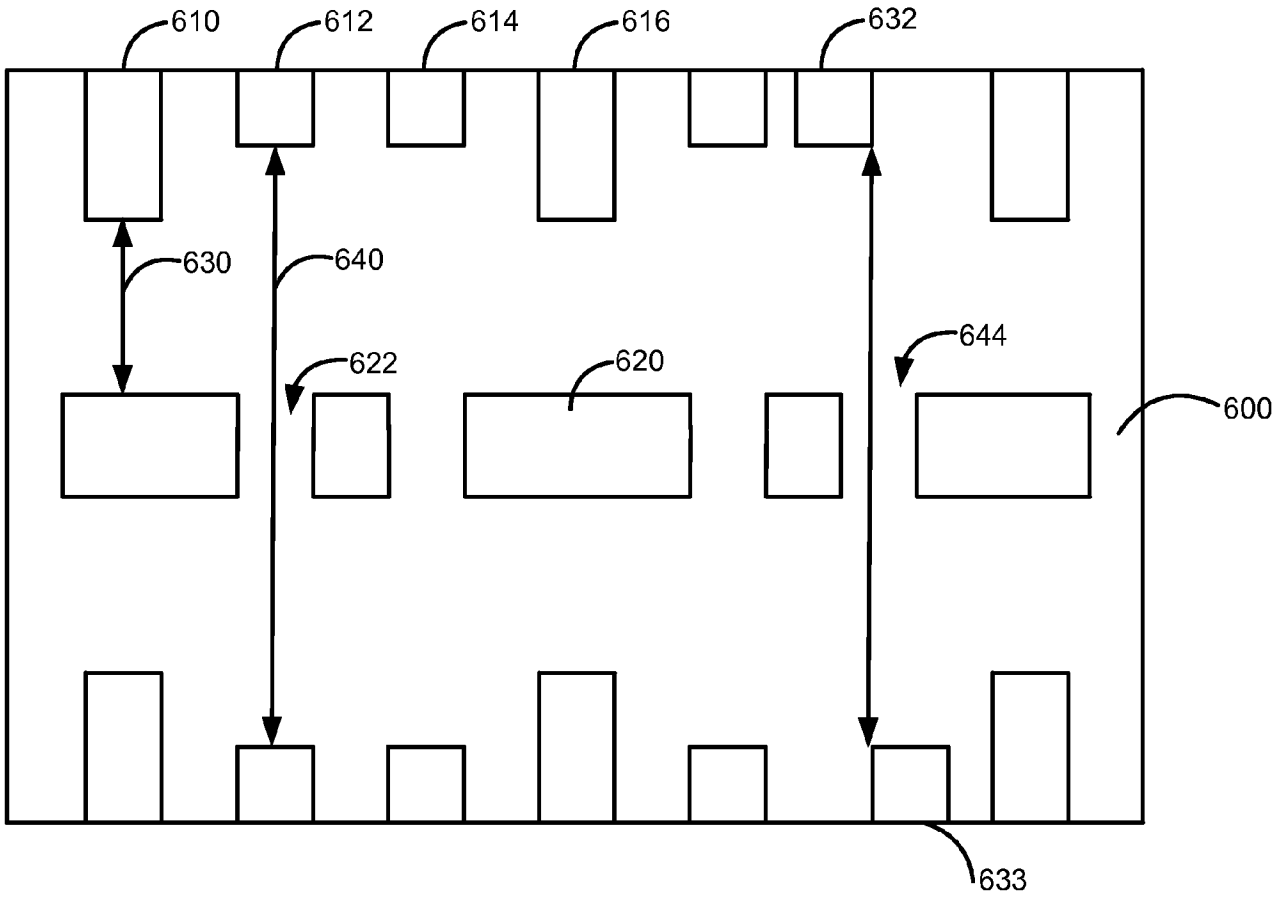
FIG. 6 illustrates another front cross-section view of a connector receptacle tongue according to an embodiment of the present invention.

FIG. 6 illustrates another front cross-section view of a connector receptacle tongue according to an embodiment of the present invention. In this example, holes 622 have been opened in ground plane 620. This may further increase distance 640 relative to distance 630, thereby further reducing impedance loss. Cross talk between signal contacts or traces 612 and 613 on opposite sides of tongue 600 may be possible with this arrangement. However, it may be that an improvement in impedance is enough to warrant use of openings 622 depending on the exact embodiment of the present invention. In various embodiments of the present invention, notches or openings, such as notches 522 and opening 622 may be located at least approximately directly below contacts 612 and the ground planes 520 and 620 may have their full dimensions elsewhere. In other embodiments of the present invention, notches or openings such as these may be joined or continuous for nearby or adjacent contacts.

In these and other embodiments of the present invention, the crosstalk between contacts or traces 612 and 613 may be mitigated by moving one or more contacts or traces laterally such that they do not align with each other. For example, contacts or traces 632 and 633 may be offset from each other such that they do not align with each other through opening 644.

Again, other embodiments of the present invention may employ more than one central power or ground plane. The above techniques may be used in these situations as well. Examples are shown in the following figures.

Figure 7:
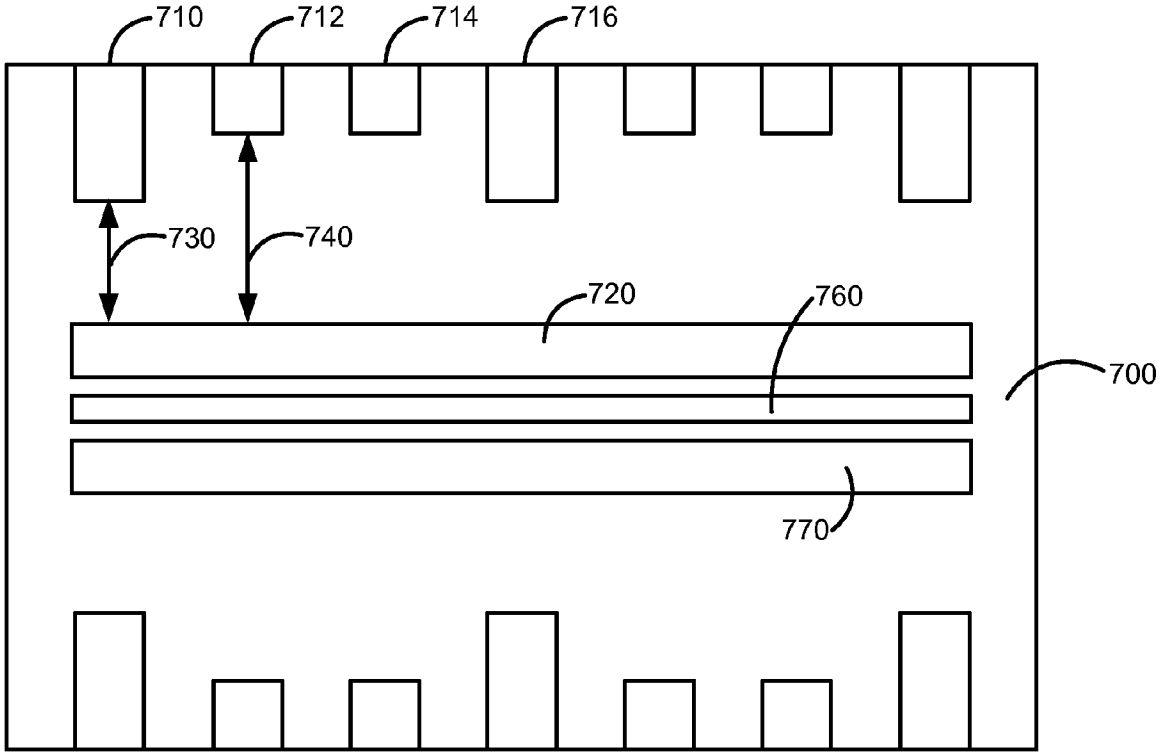
FIG. 7 illustrates another front cross-section view of a computer receptacle tongue according to an embodiment of the present invention.

FIG. 7 illustrates another front cross-section view of a computer receptacle tongue according to an embodiment of the present invention. In this example, tongue 700 may include power plane 760 having ground planes 720 and 770 on each side. In this example, a depth of signal contacts or traces 712 and 714 are reduced as compared to power and ground contacts or traces 710 and 716 such that distance 740 is greater than distance 730.

Again, a high capacitance dielectric may be placed between the power 760 and ground planes 720 and 770 in order to form bypass capacitors between power and ground. This capacitance may help to reduce the return path impedance and may help to reduce power supply noise. For example, a dielectric having a dielectric constant or relative permittivity on the order of 100 to 1,000 or higher may be used. For example, a high capacitance dielectric having a relative permittivity greater than 500 may be used.

Figure 8:
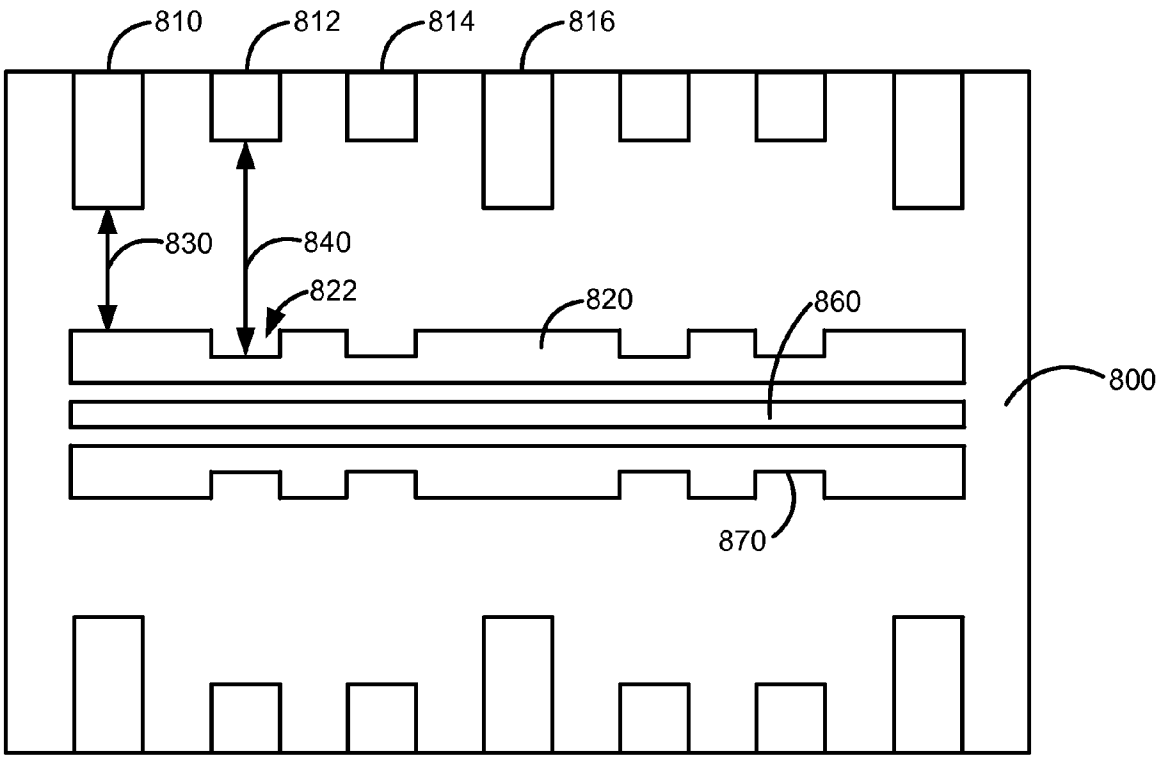
FIG. 8 illustrates another front view cross-section of a computer receptacle tongue according to an embodiment of the present invention.

FIG. 8 illustrates another front view cross-section of a computer receptacle tongue according to an embodiment of the present invention. In this example, notches 822 may be formed to further increase distance 840.

Figure 9:
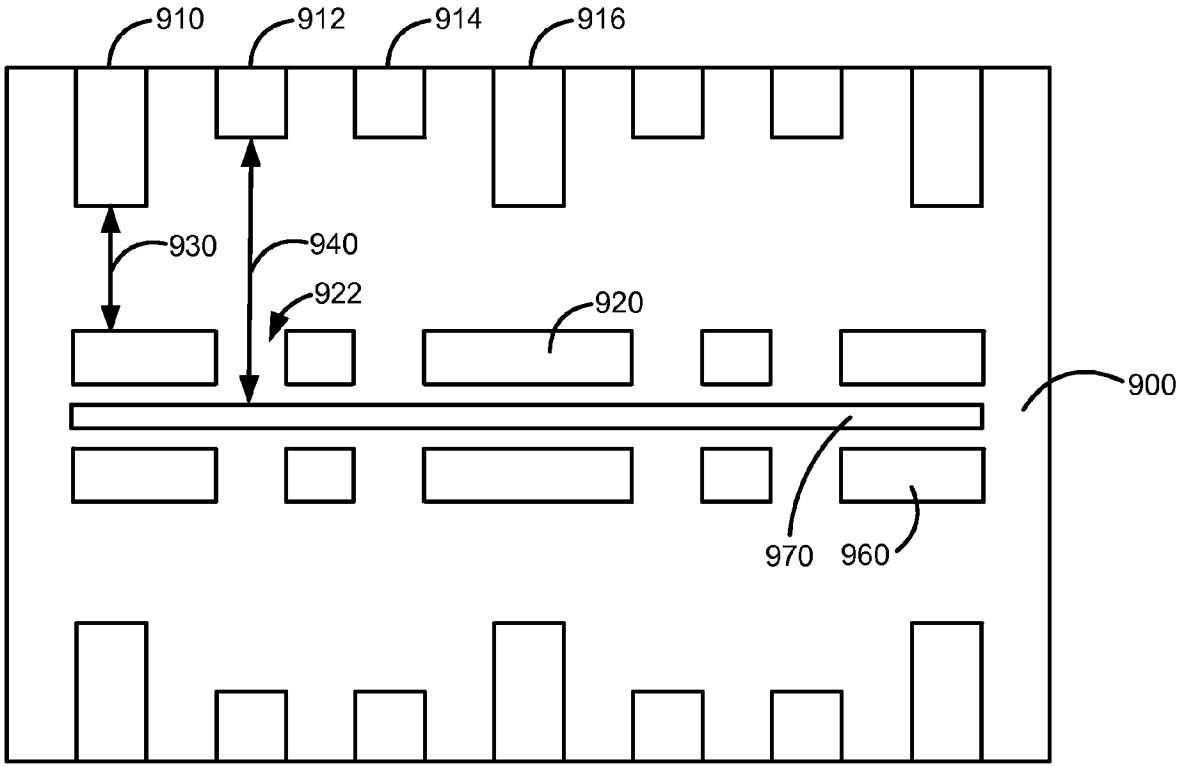
FIG. 9 illustrates another front view cross-section of a computer receptacle tongue according to an embodiment of the present invention.

FIG. 9 illustrates another front view cross-section of a computer receptacle tongue according to an embodiment of the present invention. In this example, openings 922 may be formed in ground planes 920 and 970 to further increase distance 940 as compared to distance 930. In other embodiments of the present invention, power plane 960 may have an opening as well. Again, this may result in cross talk, though improvement in impedance matching may make it worthwhile to accept this downside.

The above techniques may be used to reduce impedance losses near contacts on a connector receptacle tongue. Again, the embodiments shown in FIGS. 4-9 are particularly well-suited for use with tongues having metallic or conductive contacts, traces, and planes that are supported by tongue housings formed of plastic or other nonconductive materials, though they may be used with embodiments that employ tongues formed of printed circuit boards as well. Other embodiments of the present invention may help to prevent impedance gains that may occur at openings between a connector insert and the connector receptacle ground planes. These embodiments of the present invention may be well-suited for use with both plastic tongues and tongues formed using printed circuit boards, which again may be part of a larger logic board, motherboard, or other board in an electronic device. An example is shown in the following figure.

Figure 10:
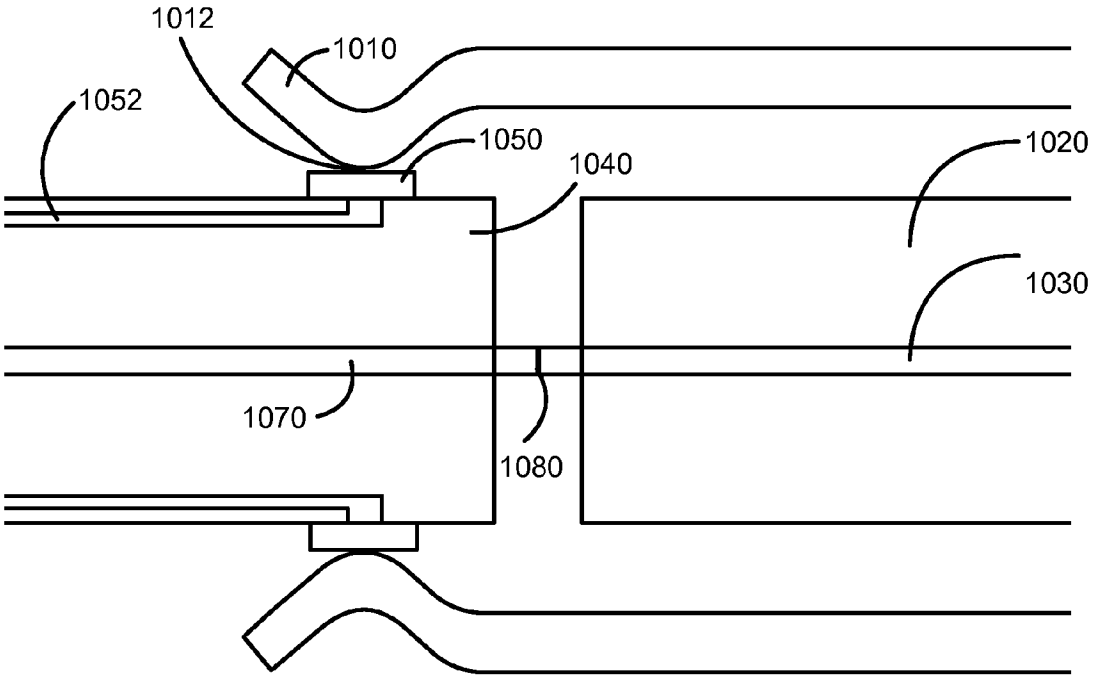
FIG. 10 illustrates another connector system according to an embodiment of the present invention.

FIG. 10 illustrates another connector system according to an embodiment of the present invention. As before, connector insert contacts 1010 may engage contacts 1050 on connector receptacle tongue 1040. Traces 1052 may electrically connect to contacts 1050. In this example, connector insert ground plane 1030 and connector tongue ground plane 1070 may be extended such that they meet at connection point 1080. This may prevent an increase in impedance in the signal path of this point. In FIG. 2, this may correspond to maintaining reducing the impedance of transmission line 220, and in FIG. 3, it may result in maintaining or reducing the impedance 320.

Again, the above embodiments of the present invention may reduce impedance errors in a signal path in a connector system. In these and other embodiments of the present invention, other impedance errors may be introduced in order to compensate for the above, and other, impedance errors. In this way, the average or effective impedance for a signal path may be close to a desired level. An example is shown in the following figure.

Figure 11:
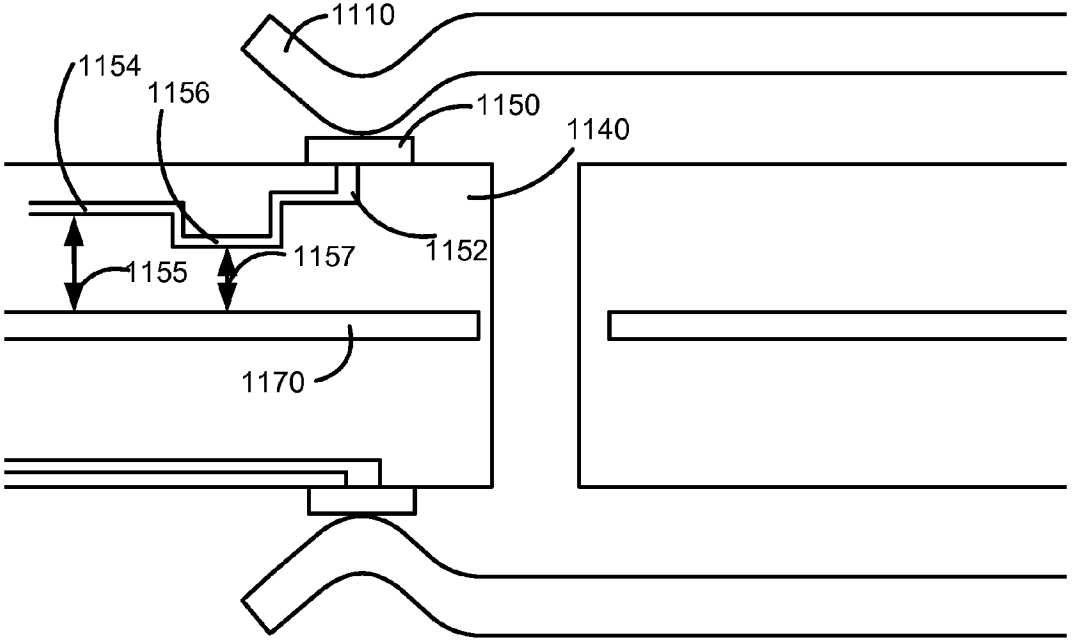
FIG. 11 illustrates another connector system according to an embodiment of the present invention.

FIG. 11 illustrates another connector system according to an embodiment of the present invention. As before, connector insert contacts 1110 may engage contacts 1150 on connector receptacle tongue 1140. Traces 1152 may electrically connect to contacts 1150. Traces 1152 may have various sections or portions, shown here as sections 1154 and 1156. The height over ground plane 1170 may vary among sections. For example, section 1154 may be spaced from ground plane 1170 by distance 1155, while section 1156 may be spaced from ground plane 1170 by distance 1157. Since distance 1157 is shorter than distance 1155, section 1156 may have a lower impedance than section 1154. These techniques may be well-suited for use in embodiments of the present invention that employ tongues formed of printed circuit boards, plastic housings, or other types of tongues.

This variation in impedance may be used to adjust the average or effective value of a signal path to be close to a desired value. In making this adjustment, it should be noted that signals propagating through the above signals paths may pass through the various high-impedance and low-impedance sections or zones in a short amount of time. That is, each of the various high-impedance and low-impedance sections may have a short delay associated with them. These delays may be shorter than the rise and fall times of the propagating signals. The result is that the variation in impedance may be reduced when compared to what may be calculated. That is, the effective impedance for each section may be closer to the desired impedance value. The effective impedance of each section, and the effective impedance of the signal path, may be determined using conventional methods, such as transmission-line theory.

For example, in FIG. 3, the impedances 320 and 340 may be determined. Again, for illustrative purposes, the impedance 320 is shown as 95 ohms, which is 10 ohms higher than the desired value, while the impedance 340 is shown as 75 ohms, which is 10 ohms less than the desired value of 85 ohms. However, since the delays through transmission line sections 220 (which corresponds to impedance 320) and 240 (which corresponds to impedance 340) may be short when compared to the rise and fall times of a signal propagating through them, the effective impedances of transmission lines 220 and 240 may be closer to 85 ohms than these calculated values. Again, these effective impedances, and the effective impedance of the signal path, may be determined using conventional methods, such as transmission-line theory.

In various embodiments of the present invention, the spacing, sizes, and arrangements of transmission line segments in a tongue may be varied to create a filter. Such a filter may remove common-mode energy from differential signal pairs and other types of signals. For example, a choke, notch, low-pass, high-pass, band-pass, or other type filter may be formed. These and similar techniques may be used to filter power supplies as well, for example by forming a common-mode low-pass or "choke" filter. An example is shown in the following figures.

Figure 12B:
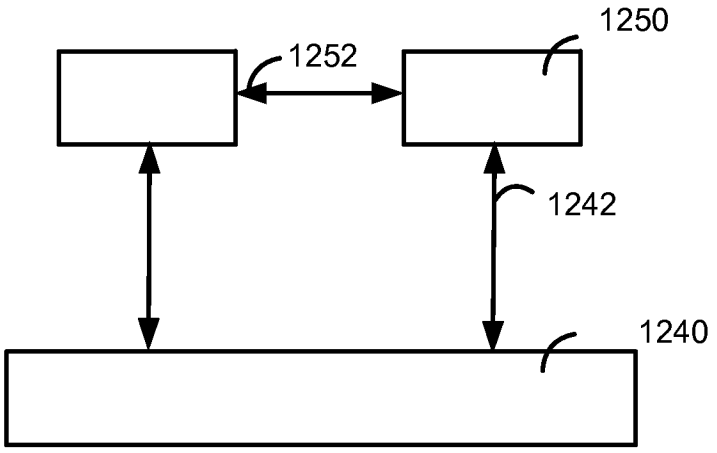
FIG. 12B illustrates a differential signal path having a high common-mode impedance according to an embodiment of the present invention.
Figure 12C:
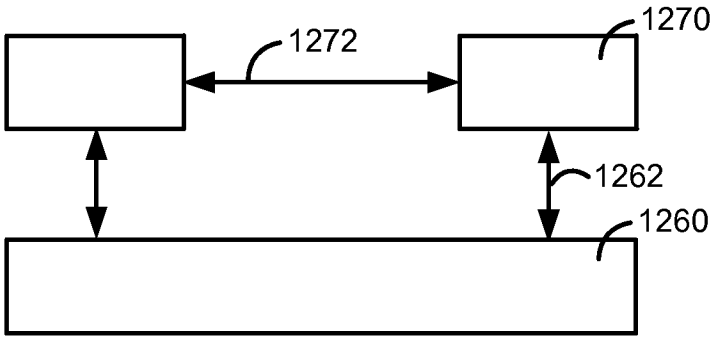
FIG. 12C illustrates a differential signal path having a low common-mode impedance according to an embodiment of the present invention.
Figure 12A:
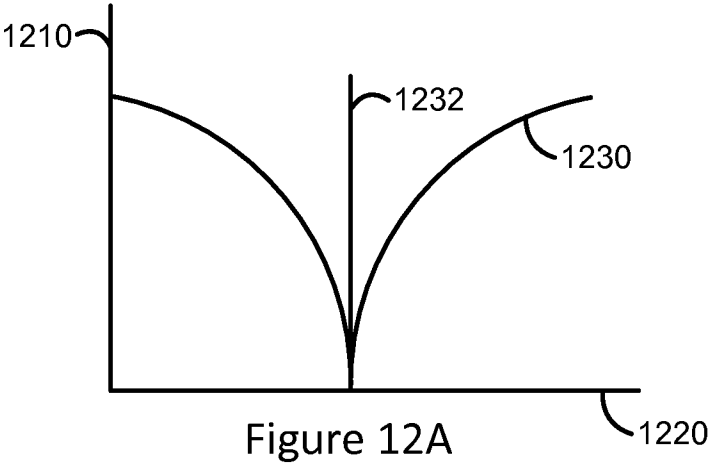
FIG. 12A illustrates a spectrum of a signal passing through signal path according to an embodiment of the present invention.

FIG. 12A illustrates a spectrum of a signal passing through signal path according to an embodiment of the present invention. A signal path may have a spectrum 1230 that may be plotted as an amplitude 1210 over frequency 1220. The spectrum may have a null or low value near a Nyquist frequency. Variations in rise and fall times caused by the above impedance mismatches may create a spike 1232 near the Nyquist frequency. Common-mode and differential-mode impedances of signal paths through the tongue may be varied to form a common-mode filter to reduce the amplitude of spike 1232.

FIG. 12B illustrates a differential signal path having a high common-mode impedance according to an embodiment of the present invention. In this example, contacts 1250 may be spaced away from ground plane 1240 by a distance 1242 and away from each other by distance 1252. When distance 1242 is relatively high, the impedance between contacts 1250 and ground plane 1240 may be high. The resulting common-mode impedance may be approximately half of the impedance between each contacts 1250 and ground plane 1240. This transmission line portion may be combined with other transmission line portions, such as the one shown in the following figure, to achieve signal filtering.

FIG. 12C illustrates a differential signal path having a low common-mode impedance according to an embodiment of the present invention. In this example, signal paths 1270 are spaced from each other by distance 1272 and are a distance 1262 above ground plane 1260. In this example, the impedance between each signal path 1270 and ground plane 1260 may be low, resulting in the low common-mode impedance.

In various embodiments of the present invention, filters may be formed of these trace sections by varying distances 1252, 1272, 1242, and 1262, both in absolute terms and relative to each other. Similarly the thickness and width of traces 1250 and 1270, in absolute terms and relative to each other, may be varied. The material between and among these structures may be varied to change the dielectric constant or permittivity These techniques may be well-suited for use in connector systems that employ tongues formed using printed circuit boards, tongues using metallic contacts, traces, and planes supported by a plastic or nonconductive housing, or other types of tongues.

Again, various techniques may be used by embodiments of the present invention to increase or otherwise vary a signal path's impedance to ground. Also, common-mode and differential-mode impedances may be varied among different sections of traces or interconnect in a connector.

These impedances may be arranged to form distributed element filters along these traces. Examples are shown in the following figures.

Figure 13:
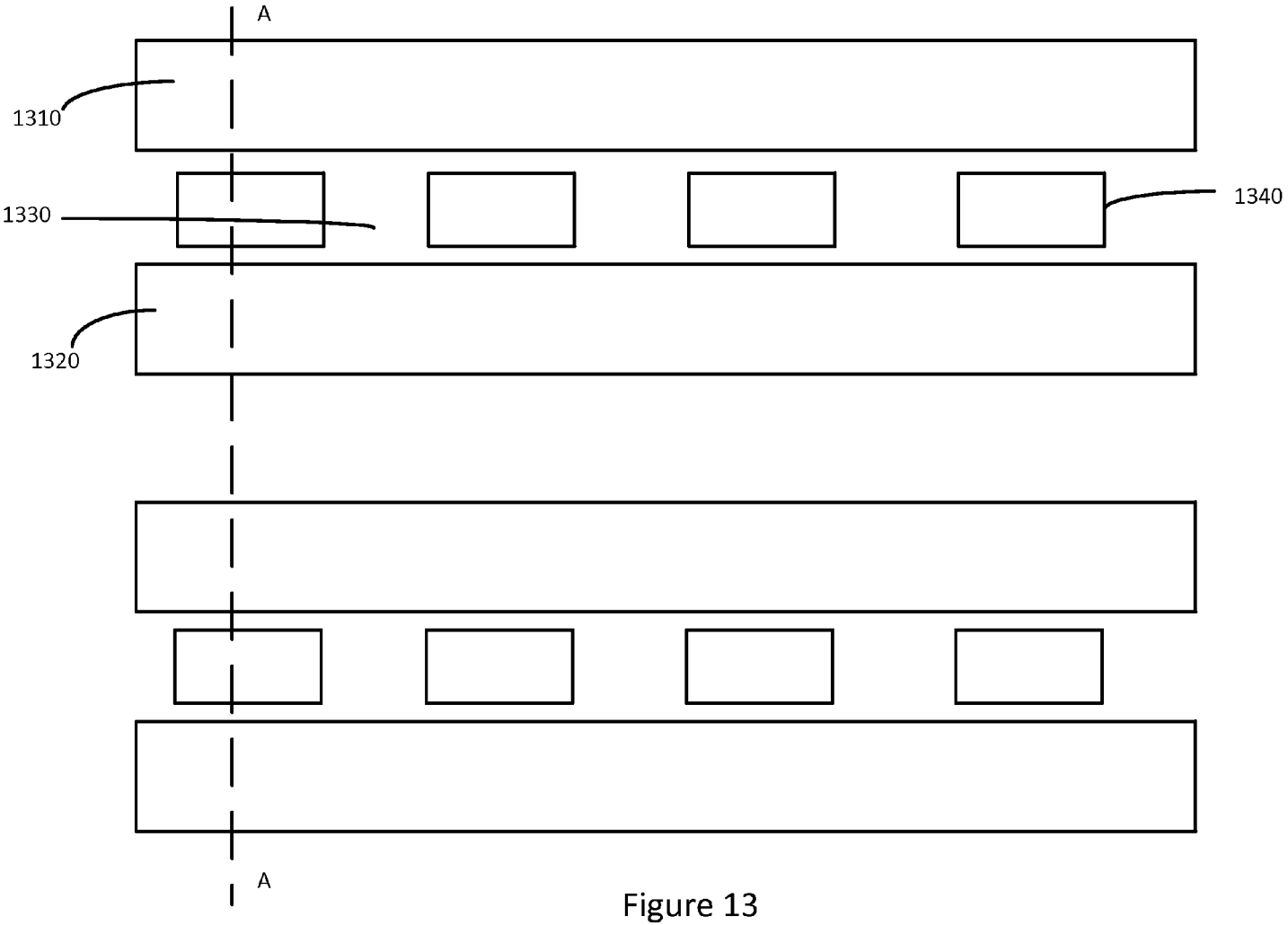
FIG. 13 illustrates a portion of a top surface of a connector tongue according to an embodiment of the present invention.

FIG. 13 illustrates a portion of a top surface of a connector tongue according to an embodiment of the present invention. In this example, two traces 1310 and 1320 may be formed on a surface of a tongue, where the tongue is formed of a material 1330. Material 1330 may be plastic or other material. Material 1330 may be removed in one or more sections 1340 from between traces 1310 and 1320. This removal may decrease a dielectric constant or permittivity between traces 1310 and 1320 near sections 1340. This decrease in the dielectric constant or permittivity may reduce coupling capacitance, thereby increasing the impedance between signal lines or traces 1300 and 1320.

In various embodiments of the present invention, sections 1340 may be formed in various ways. For example, sections 1340 may be formed by etching, molding, micro-machining, drilling, routing, cavitation, laser etching or ablation, or by using other manufacturing techniques.

Figure 14:
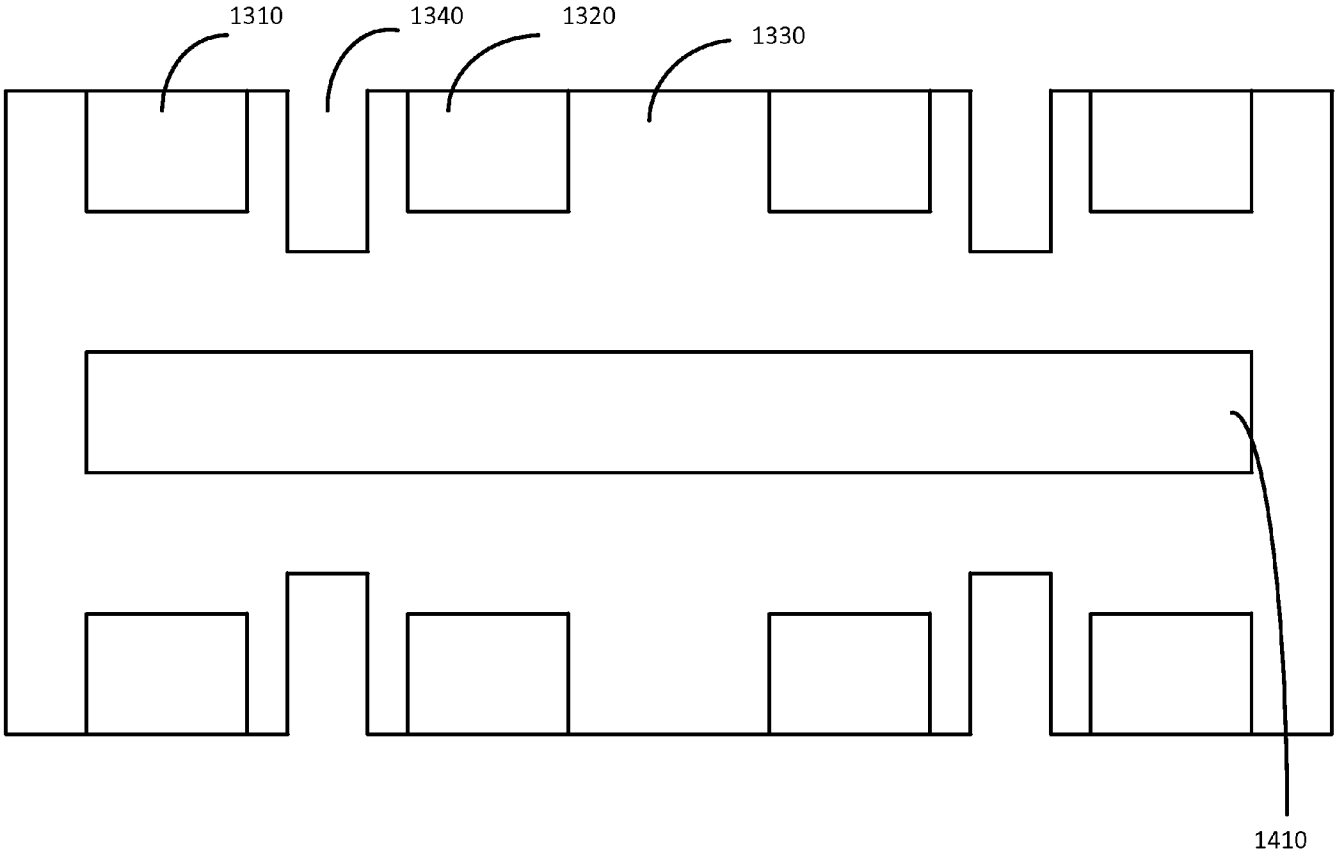
FIG. 14 illustrates a cutaway view of the tongue section of FIG. 13.

FIG. 14 illustrates a cutaway view of the tongue section of FIG. 13. This section view may be taken along cutline A-A in FIG. 13. Again, traces 1310 and 1320 may be formed in a tongue made of a material 1330. Section 1340 may be formed between traces 1310 and 1320. A center ground plane 1410 may also be included.

In this example, sections 1340 may form filter sections along traces 1310 and 1320. For example, a differential impedance between traces 1310 and 1320 may vary along their length to due to these presence of sections 1340. This may form a differential filter. In various embodiments of the present invention, these sections are short enough such that a signal may not react to their presence and may not be filtered.

In various embodiments of the present invention, impedances at a contact on a tongue may be varied. Examples are shown in the following figures.

Figure 15:
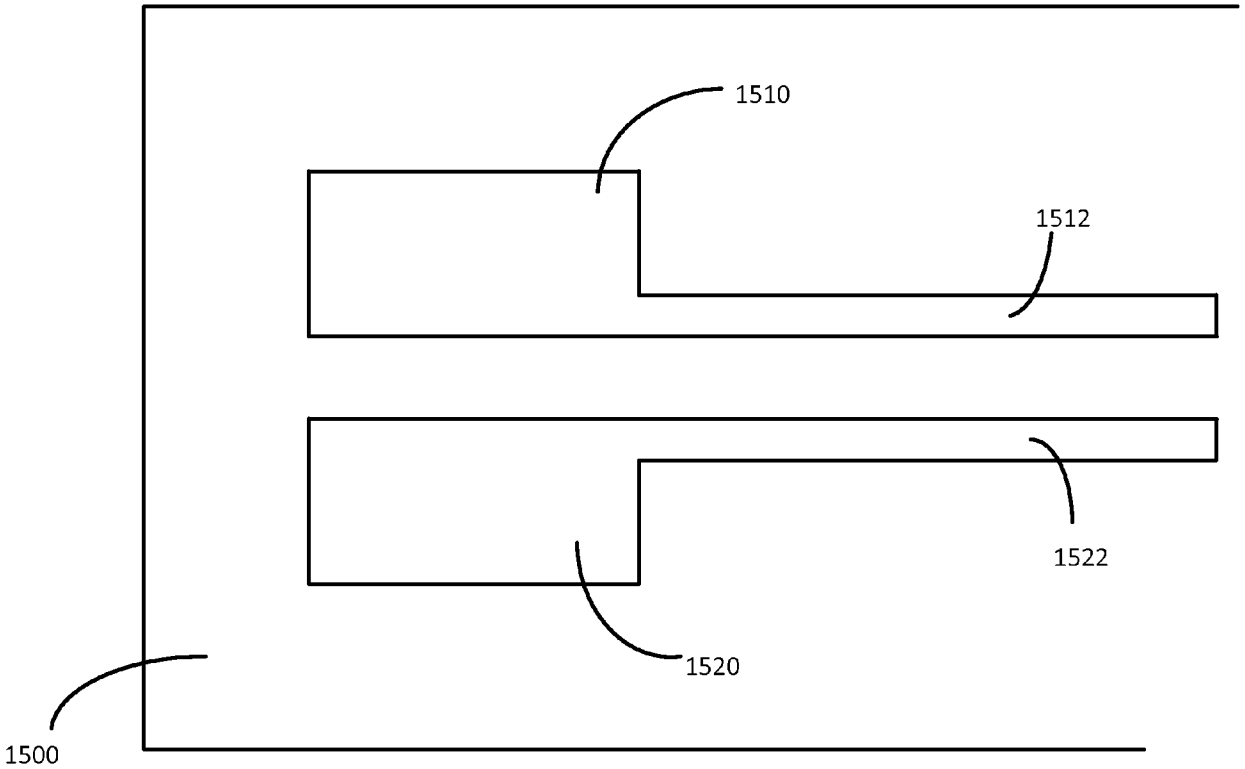
FIG. 15 illustrates a top of a connector tongue according to an embodiment of the present invention.

FIG. 15 illustrates a top of a connector tongue according to an embodiment of the present invention. In this example, tongue 1500 may include two contacts, contacts 1510 and 1520. Contacts 1510 and 1520 may form areas to be contacted by pins or contacts of a corresponding connector. Contacts 1510 and 1520 may be connected to circuitry or components through traces 1512 and 1522.

In various embodiments of the present invention, it may be desirable to either increase or decrease an impedance at contacts 1510 and 1520. It may also be desirable that these contacts form a portion of a common-mode filter. By blocking common-mode currents at these contacts, return currents may not be routed through a shield of this connector. By preventing currents from being routed on the shield, the currents do not generate a voltage at the resistance of the shield. In this way, electromagnetic interference that would otherwise be generated by the connector may be reduced.

Figure 16:
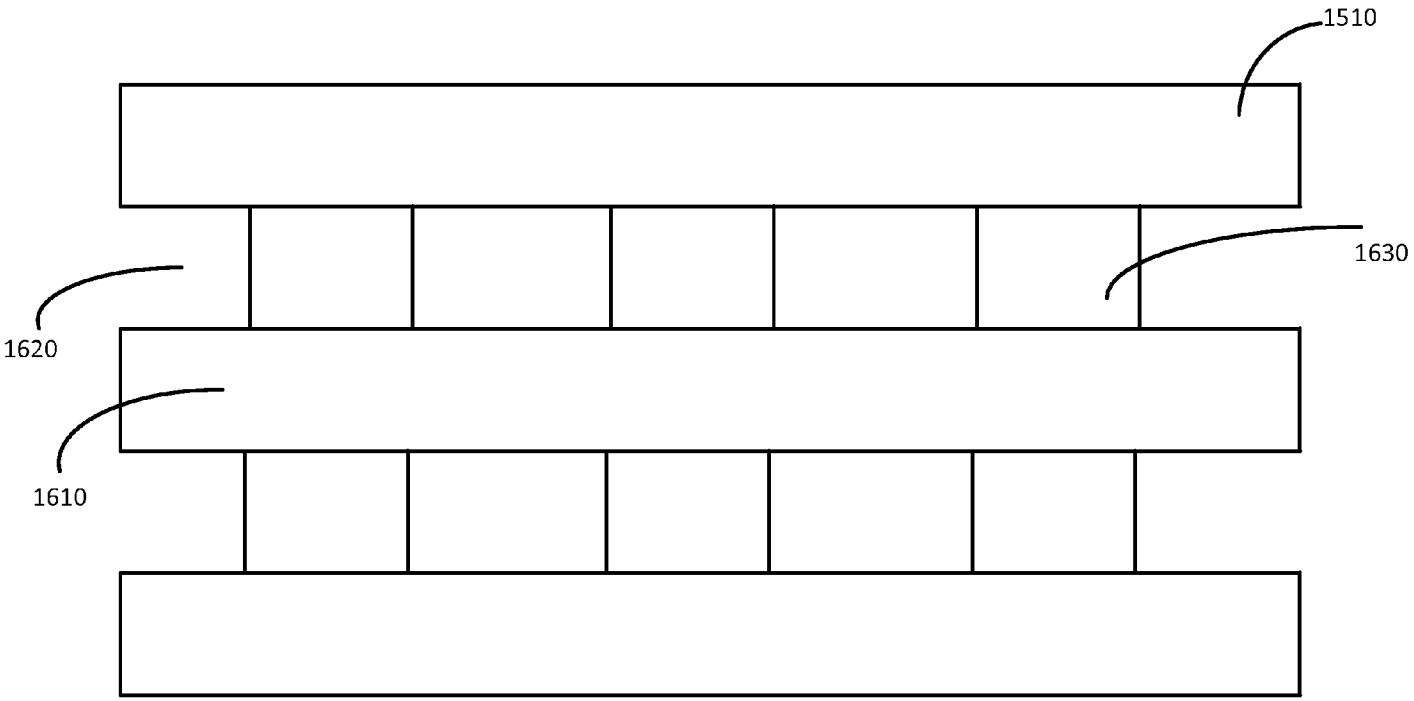
FIG. 16 illustrates a cross section of a connector tongue according to an embodiment of the present invention.

FIG. 16 illustrates a cross section of a connector tongue according to an embodiment of the present invention. In this example, contacts 1510 may be separated from center ground plane 1610 by material 1620. One or more openings 1630 may be formed in material 1620. These openings may have a lower dielectric constant, thereby decreasing a capacitance between contacts 1510 and ground plane 1610. This may result in a higher impedance for contact 1510.

In this and other examples shown, instead of simply removing material to form sections such as 1340 and 1630, other material having different dielectric constant may be used to form these sections. As before, sections 1630 may be formed by etching, molding, micro-machining, drilling, or by using other manufacturing techniques.

Figure 17:
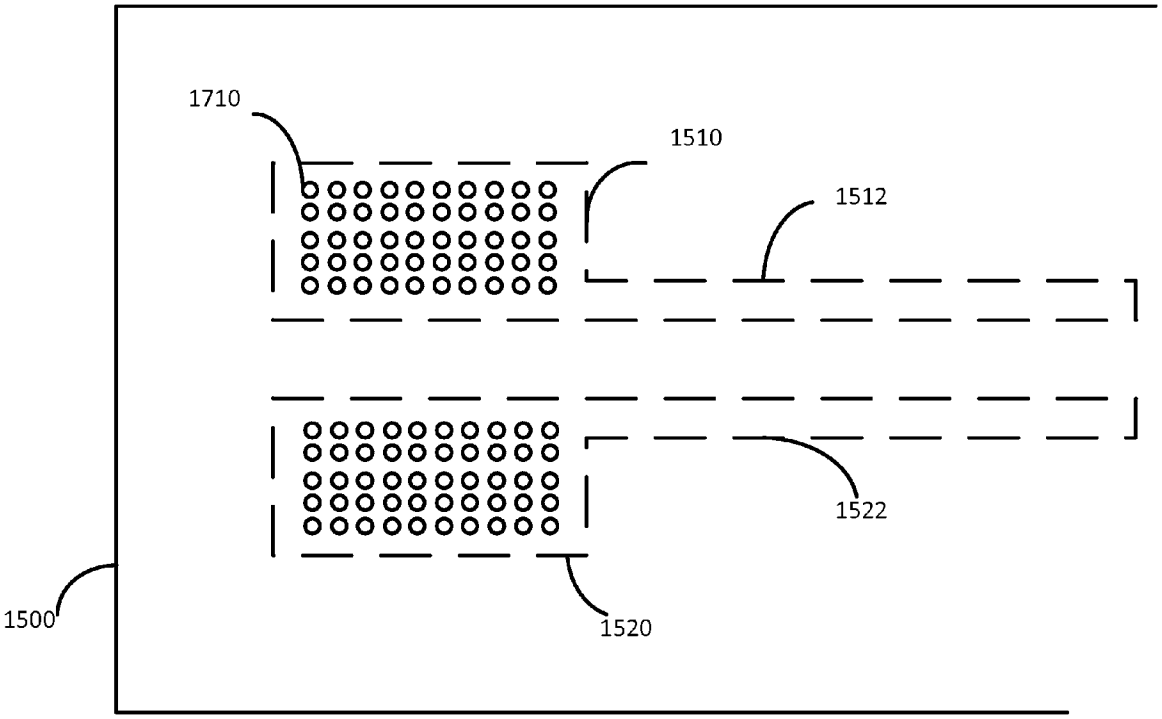
FIG. 17 illustrates a top view of a portion of a connector tongue according to an embodiment of the present invention.

FIG. 17 illustrates a top view of a portion of a connector tongue according to an embodiment of the present invention. Again, tongue portion 1500 may include contacts 1510 and 1520. Either or both the dielectric below contacts 1510 and 1520 or the center ground plane may include a number of perforations or micro-vias 1710. Perforations 1710 may be formed using a drill, etch, micro-machining, or other techniques. These perforations may act to reduce a capacitance and increase an impedance between contacts 1510 and 1520 and ground. In various embodiments of the present invention, the use of perforations 1710 may be limited to avoid weakening the structure of tongue 1500.

Again, in various embodiments of the present invention, it may be desirable to either raise or lower an impedance of a contact or trace. An example is shown in the following figure.

Figure 18:
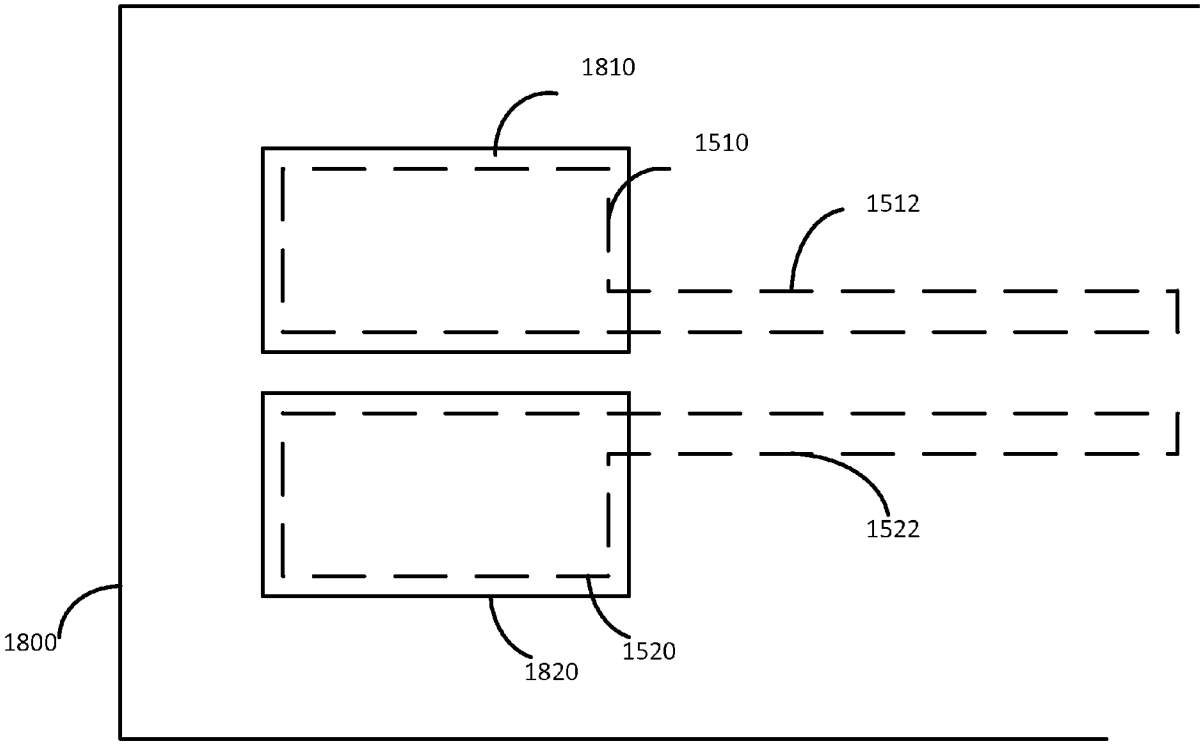
FIG. 18 illustrates a top view of a portion of a connector tongue according to an embodiment of the present invention.

FIG. 18 illustrates a top view of a portion of a connector tongue according to an embodiment of the present invention. Again, contacts 1510 and 1520 may be located over or a tongue including central ground plane 1800. Center ground plane 1800 may include features 1810 and 1820. Features 1810 and 1820 may be a lowered recess, a raised mesa, or other type of feature. A lowered recess may cause a decrease in capacitance and an increase the impedance between contacts 1510 and 1520 and center ground plane 1800. A raised mesa may increase the capacitance and decrease the impedance between contacts 1510 and 1520 and center ground plane 1800.

Figure 19:
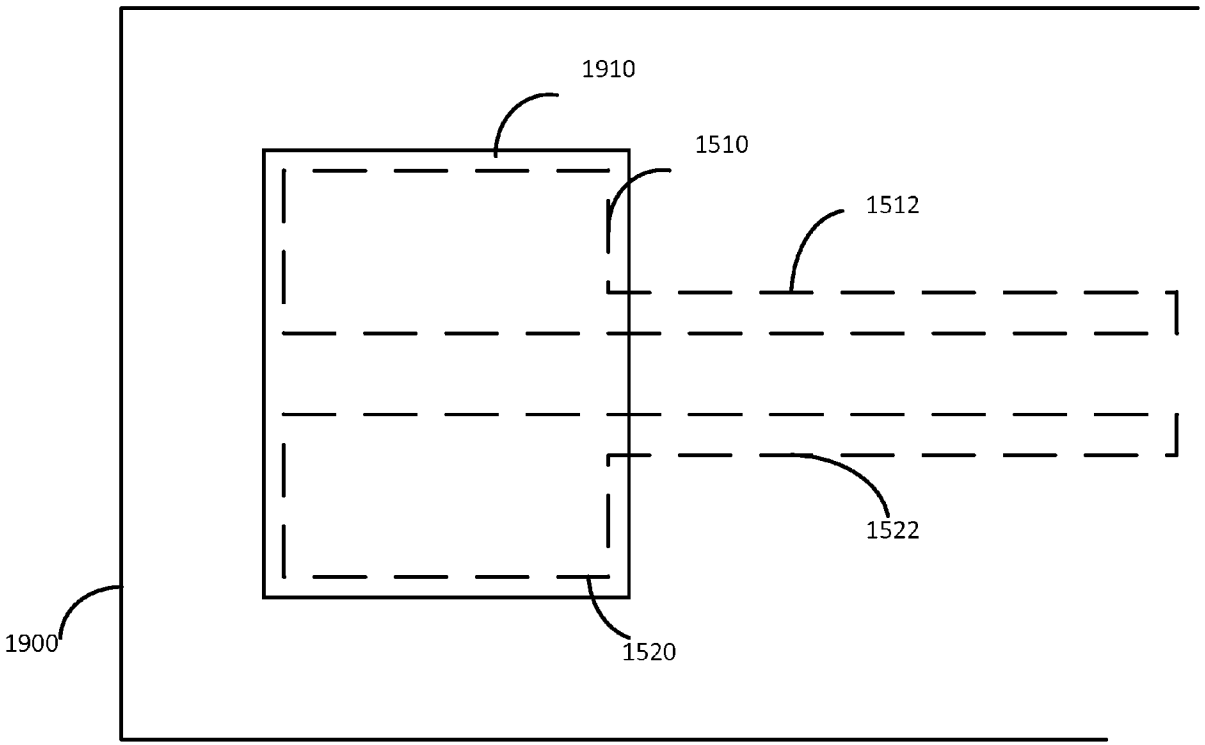
FIG. 19 illustrates a top view of a portion of a tongue according to an embodiment of the present invention.

FIG. 19 illustrates a top view of a portion of a tongue according to an embodiment of the present invention. In this example, features 1810 and 1820 have been merged into a single feature 1910.

Again, common-mode and differential-mode impedances may be varied among different sections of traces or interconnect in a connector. Other structures, such as open ended or shorted stubs may be included. These impedances may be arranged to form distributed element filters along these traces.

In these and other embodiments of the present invention, a differential-mode impedance may be kept constant while the common-mode impedance may be varied along a pair of traces, or a differential trace. These variations in common-mode impedance along a differential trace may be arranged using distributed element filter and transmission filter techniques to form filters to block common-mode signals while allowing differential-mode signals pass.

In general, to vary a common-mode impedance while maintaining a differential-mode impedance between a first section of a differential trace and a second section of a differential trace, two or more parameters, such as spacing, width, thickness, dielectric constant, or other parameter, may be varied between the first and second sections. In one example, a width and a spacing may be varied such that they cancel each other in terms of differential-mode impedance, but cause a variation in common-mode impedance along the trace. An example is shown in the following figure.

Figure 20:
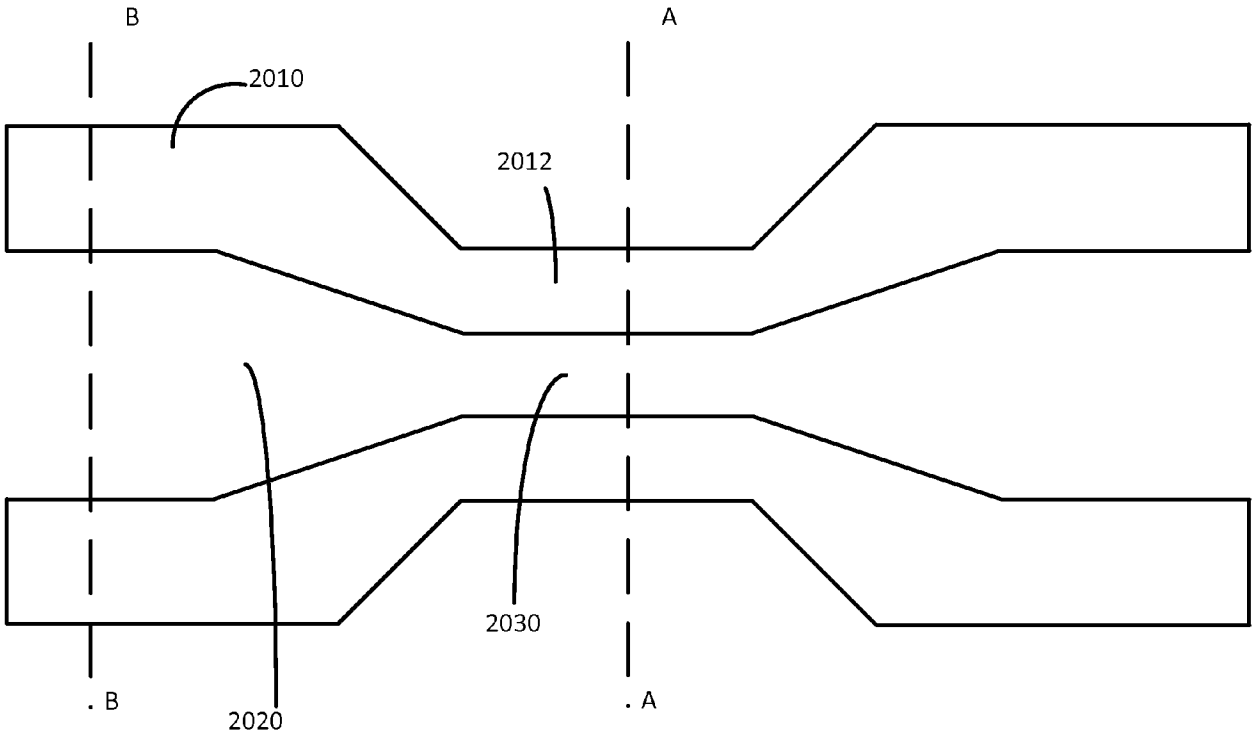
FIG. 20 illustrates a top view of a portion of a connector tongue according to an embodiment of the present invention.

FIG. 20 illustrates a top view of a portion of a connector tongue according to an embodiment of the present invention. In this example, two traces, or a differential trace, in section 2010 may be varied in spacing and width. In this example, along line B-B, the traces in section 2010 may be wider than the traces in section 2012 along line A-A. The traces in section 2010 may be further away from each other along line B-B than the traces in sections 2012 are along line A-A.

A common-mode impedance along trace section 2010 may be higher than a common-mode impedance of the section 2012. This is because the traces are wider in section 2010 than the traces in section 2012. This change in common-mode impedance may be enhanced by changing the materials below the traces in sections 2010 and 2012 such that they have different dielectric constants. The change in common-mode impedance may additionally be enhanced by changing a width of a trace or a center ground plane such that the distance between the two is varied between sections 2010 and 2012. In various embodiments of the present invention, different materials having a different dielectric constant or permittivity may be used for materials 2020 and 2030. This may be used to further change the common-mode impedance between these two sections.

Accordingly, the common-mode impedances between sections 2010 and 2012 may be different. However, the differential-mode impedance between traces in these sections may be a function of the width of traces in a section and a spacing or distance between the traces in a section. Accordingly, the since the traces are narrower but closer together in section 2012 while being wider but further spaced in section 2010, the differential-mode impedances in sections 2010 and 2012 may match.

It should be noted that the term distances as used herein may be an electrical distance and is not limited to a purely physical distance. The electrical distance may be a function of both the physical distance and the dielectric constant or permittivity of any intervening materials. Accordingly, differences in a dielectric constant or permittivity of materials 2020 and 2030 may change the electrical distance even though the physical distance between traces in sections 2010 and 2012 does not change.

In this way, common-mode impedances may be varied along a trace, while a differential-mode impedance may remain relatively constant. These sections may be arranged using distributed element filter and transmission filter techniques to form filters to block common-mode signals while allowing differential-mode signals pass.

In the above example, a width and a spacing may be varied such that they cancel each other in terms of differential-mode impedance, but cause a variation in the common-mode impedance along the differential trace. In other embodiments of the present invention, two parameters may be varied to cancel a variation in one other parameter. For example, a change in dielectric between portions of a differential trace, a change in a width of the trace, and a change in the spacing of the trace, may be varied such that the differential-mode impendence is kept constant while the common-mode impedance is varied. An example is shown in the following figure.

Figure 21:
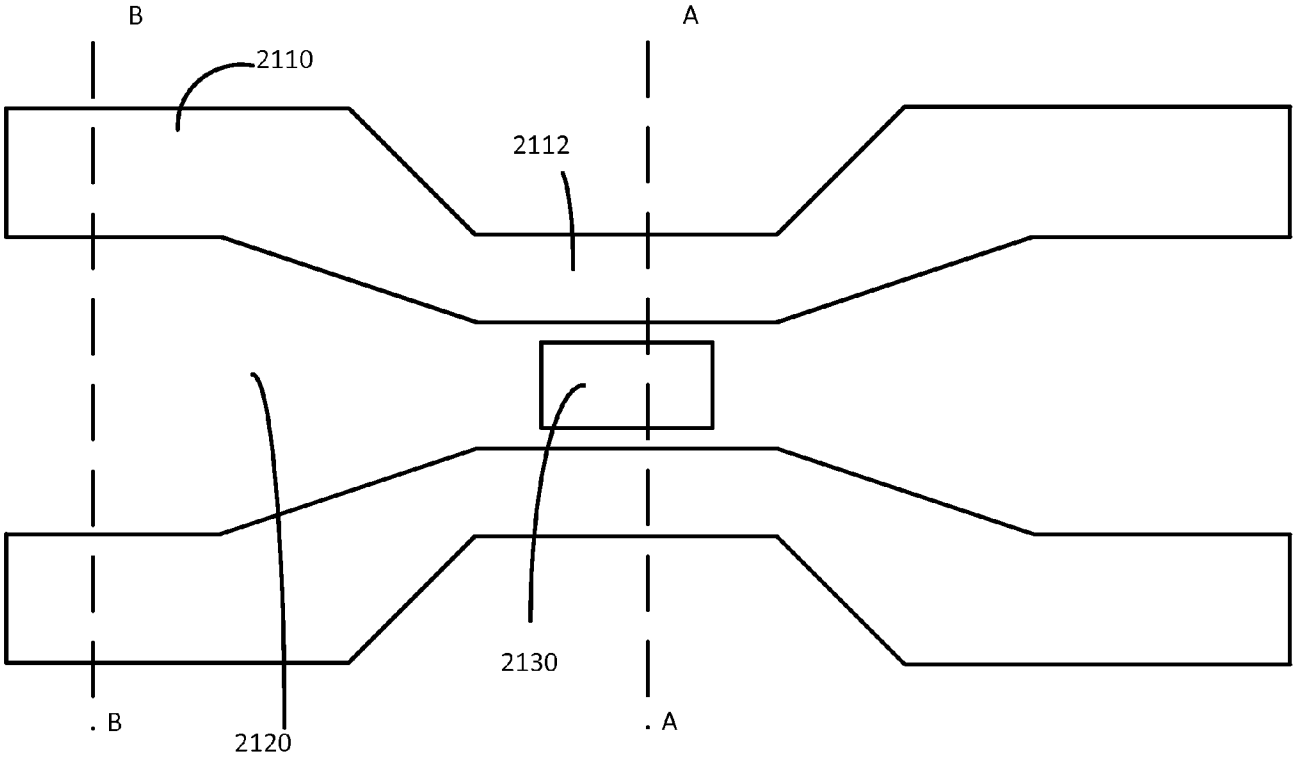
FIG. 21 illustrates another top view of a portion of a connector tongue according to an embodiment of the present invention.

FIG. 21 illustrates a portion of a top surface of a connector tongue according to an embodiment of the present invention. In this example, two traces having sections 2110 and 2112 may be formed on a surface of a tongue, where the tongue is formed of a material 2120. Material 2120 may be plastic, printed circuit board, or other material. Material 2120 may be removed in one or more sections 2130 from between trace sections 2112. This removal may decrease a dielectric constant or permittivity between trace sections 2112. This decrease in the dielectric constant or permittivity may reduce coupling capacitance, thereby increasing the differential-mode impedance between trace sections 2112.

The traces in section 2112 may also be thinner than the traces in section 2110. This may further decrease coupling capacitance between traces in section 2112, thereby further increasing the differential-mode impedance between trace sections 2112.

To compensate for these increases, the traces in section 2112 may be closer than the traces in section 2110. This may increase coupling capacitance between traces in section 2112, thereby further decreasing the differential-mode impedance between trace sections 2112. This decrease may be adjusted to compensate for the increases in differential-mode impedances caused by the traces having an opening between them and from being narrower in section 2112.

While the differential-mode impedance may be constant between sections 2110 and 2112, the common-mode impedance may vary. For example, the wider traces in section 2110 may result in a higher capacitance to a central ground plane, leading to a lower common-mode impedance as compared to the trace sections 2112.

In various embodiments of the present invention, opening sections 2130 may be formed in various ways. For example, opening sections 2130 may be formed by etching, molding, micro-machining, drilling, cavitation, laser etching or ablation, or by using other manufacturing techniques.

In various embodiments of the present invention, contacts, ground planes, traces, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connectors that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connectors may provide pathways for signals that are compliant with various standards such as Universal Serial Bus (USB) including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connectors that may be used to provide a reduced set of functions for one or more of these standards. In various embodiments of the present invention, these interconnect paths provided by these connectors may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector system comprising:

a connector insert having a first contact; and a connector receptacle comprising:

a second contact; and a first trace on a tongue, the first trace coupled to the second contact, wherein the first contact engages the second contact, and wherein the first contact, the second contact, and the first trace form a signal path when the connector insert is inserted in the connector receptacle, and wherein the signal path has an average impedance along its length, the impedance of the signal path at the second contact is lower than the average impedance, and the impedance of the signal path along a portion of the first trace is higher than the average impedance, wherein the average impedance, the impedance of the signal path at the second contact, and the impedance of the signal path along a portion of the first trace are impedances at a frequency of data signals conveyed by the signal path.

2. The connector system of claim 1 wherein the impedance of the signal path along the first trace is varied such that a filter to reduce the common-mode energy of signals conveyed on the signal path is formed.

3. The connector system of claim 1 wherein the connector insert further comprises a housing, the housing having a central ground plane.

4. The connector system of claim 3 wherein a first portion of the first contact is over the central ground plane and the impedance of the signal path between the first portion of the first contact and the tongue is higher than the average impedance.

5. The connector system of claim 1 wherein the first contact comprises a spring-finger contact.

6. The connector system of claim 5 wherein the second contact is a surface contact on the tongue of the receptacle.

7. The connector system of claim 1 wherein when the connector insert is inserted into the connector receptacle, spring finger contacts in the insert contact surface contacts on the tongue in the receptacle.

8. The connector system of claim 7 wherein the tongue is formed of a multi-layer printed circuit board.

9. The connector system of claim 8 wherein the surface contacts are printed on top and bottom sides of the multi-layer printed circuit board.

10. The connector system of claim 9 further comprising a ground plane on a layer at least near a center of the multi-layer printed circuit board, wherein a portion of the ground plane is thinned below the first contact.

11. The connector system of claim 10 further comprising a power plane on a first layer at least near a center of the multi-layer printed circuit board, a first ground plane on a second layer above the power plane and a second ground plane on a third layer below the power plane, wherein a portion of the first ground plane is either thinned or open below the first contact.

12. The connector system of claim 1 wherein the average impedance of the signal path at a frequency of data signals conveyed by the signal path is a function of inductances and capacitances of the signal path, the impedance of the signal path at the second contact at a frequency of data signals conveyed by the signal path is a function of inductances and capacitances of the second contact, and wherein the impedance of the signal path along a portion of the first trace at a frequency of data signals conveyed by the signal path is a function of the inductances and capacitances of the signal path along the portion of the first trace.

13. A connector receptacle comprising:

a first contact; and a first trace on a tongue, the first trace coupled to the first contact, wherein first contact and first trace form a signal path, and wherein the signal path has an average impedance along its length, the impedance of the signal path at the first contact is lower than the average impedance, and the impedance of the signal path along a portion of the first trace is higher than the average impedance, wherein the average impedance, the impedance of the signal path at the first contact, and the impedance of the signal path along a portion of the first trace are impedances at a frequency of data signals conveyed by the signal path.

14. The connector receptacle of claim 13 wherein the impedance of the signal path along the first trace is varied such that a filter to reduce the common-mode energy of signals conveyed on the signal path is formed.

15. The connector receptacle of claim 13 wherein the first contact is one of a plurality of surface contact contacts on the tongue of the receptacle.

16. The connector receptacle of claim 15 wherein the tongue is formed of a multi-layer printed circuit board.

17. The connector receptacle of claim 16 wherein the plurality of surface contacts are printed on top and bottom sides of the multi-layer printed circuit board.

18. The connector receptacle of claim 17 further comprising a ground plane on a layer at least near a center of the multi-layer printed circuit board, wherein a portion of the ground plane is thinned below the first contact.

19. The connector receptacle of claim 18 further comprising a power plane on a first layer at least near a center of the multi-layer printed circuit board, a first ground plane on a second layer above the power plane and a second ground plane on a third layer below the power plane, wherein a portion of the first ground plane is either thinned or open below the first contact.

20. The connector receptacle of claim 19 wherein a high capacitance dielectric having a relative permittivity greater than 500 is located between the first ground plane and the power plane, and between the power plane and the second ground plane.

21. The connector receptacle of claim 13 wherein the average impedance of the signal path at a frequency of data signals conveyed by the signal path is a function of inductances and capacitances of the signal path, the impedance of the signal path at the first contact at a frequency of data signals conveyed by the signal path is a function of inductances and capacitances of the first contact, and wherein the impedance of the signal path along a portion of the first trace at a frequency of data signals conveyed by the signal path is a function of the inductances and capacitances of the signal path along the portion of the first trace.

* * * * *